US005137802A

United States Patent [19]

Ueda et al.

[11] Patent Number: 5,137,802

[45] Date of Patent: Aug. 11, 1992

[54] SILVER HALIDE PHOTOGRAPHIC MATERIAL WITH IMPROVED ANTISTATIC PROPERTIES

[75] Inventors: Eiichi Ueda; Noriki Tachibana; Nobuaki Kagawa; Minoru Ishikawa; Hideo Ota, all of Hino, Japan

[73] Assignee: Konishiroku Photo Industry Co., Ltd., Tokyo, Japan

[21] Appl. No.: 633,174

[22] Filed: Dec. 28, 1990

Related U.S. Application Data

[63] Continuation of Ser. No. 323,092, Mar. 13, 1989, abandoned, which is a continuation of Ser. No. 40,793, Apr. 21, 1987, abandoned.

[30] Foreign Application Priority Data

Apr. 21, 1986 [JP] Japan ..... 61-92941
May 12, 1986 [JP] Japan ..... 61-107857
Jun. 26, 1986 [JP] Japan ..... 61-149930

[51] Int. Cl.[5] ..... G03C 1/76

[52] U.S. Cl. ..... 430/523; 430/527; 430/961

[58] Field of Search ..... 430/527, 961, 523

[56] References Cited

U.S. PATENT DOCUMENTS 4,004,927 1/1977 Yamamoto et al. ..... 430/961
4,047,958 9/1977 Yoneyama et al. ..... 430/527
4,362,812 12/1982 Minamizono et al. ..... 430/961
4,366,238 12/1982 Yokoyama et al. ..... 430/961
4,418,144 11/1983 Kawaguchi et al. ..... 430/527
4,585,730 4/1986 Cho ..... 430/961
4,610,955 9/1986 Chen et al. ..... 430/527
4,675,278 6/1987 Sugimoto et al. ..... 430/961

FOREIGN PATENT DOCUMENTS 1417915 12/1975 United Kingdom .

OTHER PUBLICATIONS

Research Disclosure RD-10147, pp. 69-71, Havant, Hampshire, GB, vol. 101, Sep. 1972.

*Primary Examiner*—Jack P. Brammer
*Attorney, Agent, or Firm*—Finnegan, Henderson, Farabow, Garrett and Dunner

[57] ABSTRACT

A silver halide photographic material having a layer containing an electrically conductive material formed on one surface of a support and at least one silver halide emulsion layer formed on the other surface of the support is disclosed, wherein the outermost layer on the side where the silver halide emulsion layer is formed contains an organopolysiloxane and a nonionic surfactant having a polyoxyethylene unit, the latter being optionally combined with, or replaced by, a fluorine-containing compound.

4 Claims, No Drawings

SILVER HALIDE PHOTOGRAPHIC MATERIAL WITH IMPROVED ANTISTATIC PROPERTIES

This application is a continuation of application Ser. No. 07/323,092, filed Mar. 13, 1989, which is a continuation of application Ser. No. 07/040,793 filed Apr. 21, 1987, both now abandoned.

BACKGROUND OF THE INVENTION

1. Field of the Invention

The present invention relates to a silver halide photographic material and, more particularly, to a silver halide photographic material having improved antistatic properties.

Supports used in photographic materials are electric insulators and are easily electrified when they are rubbed against or peeled away from other objects. The resulting static charges on the supports can cause various troubles such as attraction of dust particles, the occurrence of electric shocks, and of fire. In the manufacture of silver halide photographic materials using such supports, frequent cycles of friction and peeling occur in various steps such as winding, rewinding, application of light-sensitive layers and various other coating layers, and transport of the web being dried. If the static electricity that has been generated as a result of such friction and peeling phenomena is discharged, the photosensitive material carrying light-sensitive layers becomes exposed and will produce static marks after development (i.e., uneven development due to static buildup). Such static marks and various other troubles due to the deposition of foreign matter such as dust particles will also occur during the use or processing of the manufactured photographic materials. Since the severity of static marks is increased as the sensitivity of the photographic materials increases, there is a growing need to establish a technique for minimizing the occurrence of static marks on modern photographic materials that feature ever increasing degrees of sensitivity. In addition, the current manufacturing practice of photographic materials involves an increased chance of their being handled under hostile conditions as a consequence of faster coating and drying operations and processing with a high-speed automatic developer, and this has given another impetus to the development of a technique that is capable of minimizing the occurrence of various troubles due to static buildup.

Various methods have been known to be effective against the troubles associated with static electricity on photographic materials. According to the most popular and commonly used method, the back side of a photographic material (viz., the side on which no light-sensitive layer is formed and is hereinafter referred to as the BC layer) is provided with a layer containing an ion-conductive material, such as a gelatin layer containing sodium polyphosphoric acid, a diacetylcellulose layer containing an electrolyte-containing metal oxide sol, or an ionic polymer layer, that imparts electrical conductivity to the photographic material and thereby decreases the chance of static buildup. However, if this method is applied to the actual silver halide photographic material, certain undesirable phenomena occur in various ways: for instance, if a roll of photographic material or stacked sheets of photographic material are placed in a humid atmosphere, adjacent layers will stick to each other; if this "blocking" problem does not occur, a phenomenon that may be described as "time-dependent deterioration of the electrical conductivity of a film roll in high humidity" will occur and the electrical conductivity of the BC layer in one specimen is reduced as a result of partial transfer of the ion-conductive material to the obverse surface (i.e., the side carrying silver halide emulsion layers) of another specimen with which the first specimen comes in contact.

With a view to solving these problems, it has been proposed that a protective layer of a hydrophobic polymer be provided on the electroconductive layer. This method is effective in preventing the occurrence of blocking in high humidity but does not make any substantial contribution to reduction in the time dependent deterioration of electroconductivity of a film roll in high humidity. If the overlying hydrophobic layer is of adequate thickness, the diffusion of ions from the conductive layer can be satisfactorily prevented but then the support will experience too much curling to be suitable for use in practical applications.

Attempts have therefore been made to suppress the time-dependent deterioration of the conductivity of the electrically conductive layer by rendering it hydrophobic before it is coated with a hydrophilic layer. For instance, British Patent No. 1,172,999 discloses a method of increasing the hydrophobicity of a conductive layer derived from an ethylenically unsaturated compound by forming it from a copolymer of a hydrophilic monomeric electrolyte and a hydrophobic monomer. Japanese Patent Application (OPI) No. 18728/1979 (the term "OPI" as used herein means an unexamined published Japanese patent application) shows the use of a comparatively hydrophobic ionene polymer having a dissociative group in the backbone chain. Japanese Patent Application (OPI) No. 59926/1979 proposes a method for producing a homogeneous film of an electrolyte-containing sol and a hydrophobic polymer, with the latter being dissolved in an organic solvent.

These methods which rely on the formation of a hydrophobic layer on an ion-conductive film that has been rendered hydrophobic are effective for the purpose of preventing the occurrence of blocking in a humid condition but are far less effective in minimizing the time-dependent deterioration of the electrical conductivity of a film roll in high humidity. Furthermore, the hydrophobic ion-conductive layer is low in electrical conductivity, eventhough increasing it has been the principal object of these approaches, and in practice they fail to provide photographic materials with the desired antistatic properties.

Numerous efforts have also been made to improve the antistatic properties of silver halide emulsion layers by, for example, incorporating various hygroscopic substances, water-soluble inorganic salts, certain surfactants and polymers in either the silver halide emulsion layers or overlying protective layers. Surfactants are particularly important antistatic agents and among the so far proposed surfactants are anionic, betaine-based and cationic surfactants of the types described in U.S. Pat. Nos. 3,082,123, 3,201,251, 3,519,561 and 3,625,695; West German Patent Nos. 1,552,408 and 1,597,472; Japanese Patent Application (OPI) Nos. 85826/1974, 129623/1978, 159223/1979, 19213/1973; Japanese Patent Publication Nos. 39312/1971, 11567/1974, 46755/1976 and 14417/1980; and nonionic surfactants of the types described in Japanese Patent Application (OPI) No. 80023/1977, West German Patent Nos.

1,422,809 and 1,422,818, and Australian Patent No. 54,441/1959.

However, the performance of some of these substances depends not only on the type of specific film support but also on the specific photographic composition. One substance exhibits good results when it is used with a certain film support or photographic emulsion and other photographic constituent elements but is entirely ineffective for antistatic purposes if used with other film supports or photographic constituent elements. Alternatively, some materials that display superior antistatic properties cause adverse effects on the photographic characteristics of a photographic emulsion, such as sensitivity, fog, granularity and sharpness. For these reasons, extreme difficulty has been encountered in trying to incorporate these substances into photographic materials.

Nonionic surfactants having a polyoxyethylene unit display comparatively good antistatic properties and ethylene oxide addition polymers of the condensation product of phenol and formaldehyde (as described in Japanese Patent Publication Nos. 8742/1972, 9610/1976, 18178/1982, 19406/1982, 43729/1983, Japanese Patent Application (OPI) Nos. 48520/1979, 101140/1981, 80648/1985, 208743/1983, 203435/1983, etc.) have proved to be fairly effective antistats as they cause minimal adverse effects on the photographic characteristics of a photographic material and yet their performance is not highly dependent on the type of specific film support or photographic composition.

If a silver halide emulsion or protective layer employing a nonionic surfactant having a polyoxyethylene unit is provided on a support that has the aforementioned ion-conductive film formed on the BC layer, a remarkable improvement is attained in the ordinary antistatic performance but, on the other hand, the defect inherent in the technique of forming an ion-conductive film on the BC layer, namely, the time-dependent deterioration of the electrical conductivity of a film roll in high humidity, becomes even more pronounced, and if the photographic material prepared by employing this technique is handled under dry conditions after storage in a humid atmosphere, static marks and other troubles due to static buildup will frequently occur.

Besides these nonionic surfactants, fluorine-containing compounds that inhibit static buildup by generating weak electricity are also known as superior antistats. Such fluorine-containing compounds include F-containing surfactants and F-containing polymers: compounds of the first class are shown in such patents as British Patent Nos. 1,293,189, 1,259,398, U.S. Pat. Nos. 3,666,478, 3,754,924, 3,775,236, Japanese Patent Application (OPI) Nos. 48520/1979, 114944/1981, 161236/1975, 151127/1976, 59025/1975, 113221/1975, 99525/1975, Japanese Patent Publication Nos. 44411/1981, 6577/1982, Japanese Patent Application Nos. 83566/1982, 80773/1982, Japanese Patent Application (OPI) Nos. 84712/1978, 64228/1982, 258542/1985, and general references such as I & EC Product Research and Development, 1 (3), September 1962 and Abura Kagaku (Oil Chemistry), 12, (12), pp. 652–653, 1963; while compounds of the second class are described in such patents as Japanese Patent Application (OPI) Nos. 158222/1979, 129520/1977, 23828/1974, British Patent Nos. 1,352,975, 1,497,256, U.S. Pat. Nos. 4,087,394, 4,016,125, 3,240,604, 3,679,411, 3,340,216, 3,632,534, Japanese Patent Application (OPI) Nos. 30940/1973, 129520/1977, 44973/1985, 210613/1985, 11342/1982, 76742/1985, 80849/1985, and U.S. Pat. No. 3,753,716. It has been known to improve the antistatic properties of light-sensitive materials by incorporation of these fluorine-containing compounds.

If a silver halide emulsion or protective layer that contains one or more of these fluorine-containing compounds is provided on a support that has the aforementioned ion-conductive film formed on the BC layer, the accelerated deterioration of the electrical conductivity of the BC layer in a film roll at high humidity, which is the problem resulting from the use of a non-ionic surfactant having a polyoxyethylene unit, can be reduced by a satisfactory degree. However, the antistatic effect of the fluorine-containing compounds in the emulsion layer or protective layer is decreased if the film roll is stored in a humid atmosphere, and the chance of static marks and other troubles associated with static buildup occurring is eventually increased.

As described above, if photographic materials are stored in a stacked form under humid conditions, with the ion-conductive layer on the back side of a support being in contact with the emulsion or protective layer of an adjacent sheet of photographic material that contains a fluorine-containing compound or a nonionic surfactant having a polyoxyethylene unit, the antistatic effect of the ion-conductive layer is deteriorated to increase the chance of the development of static marks and other troubles associated with static buildup.

Modern silver halide photographic materials are designed to meet the ever growing demand for higher sensitivity and amenability to rapid processing with developers of a very small size. These factors contribute to a greater chance of static marks being produced as a result of increased triboelectrification. In developing machines of a small size, the emulsion coated side of a silver halide photographic material is kept in contact with transport rollers under strong force and, hence, has a great tendency to develop static marks across its entire surface. In order to avoid these problems, there has been a strong need to design a silver halide photographic material having improved antistatic properties.

SUMMARY OF THE INVENTION

An object, therefore, of the present invention is to provide a silver halide photographic material having good antistatic properties which is capable of minimizing the occurrence of static marks.

Another object of the present invention is to provide an improved silver halide photographic material that will not experience any substantial deterioration in antistatic performance even if a film roll of the photographic material is stored in a humid atmosphere.

These objects of the present invention can be attained by a silver halide photographic material that has a layer containing an electrically conductive material formed on one surface of a support and at least one silver halide emulsion layer formed on the other surface of the support, wherein the outermost layer on the side where the silver halide emulsion layer is formed contains an organopolysiloxane and a nonionic surfactant having a polyoxyethylene unit, the latter being optionally combined with, or replaced by, a fluorine-containing compound.

DETAILED DESCRIPTION OF THE INVENTION

The present invention is hereinafter described in detail. Any of the supports that are commonly used in conventional photographic materials may be used in the present invention, and they include: films of polyolefins (e.g. polyethylene), polystyrenes, cellulose derivatives (e.g. cellulose triacetate), and cellulose esters (e.g. polyethylene terephthalate); sheets in which both sides of baryta paper, synthetic paper and conventional paper are coated with one of the films mentioned above. Supports that are composed of these materials and equivalents of such supports may be used in the present invention.

The electrically conductive material to be incorporated in one surface of the support of the silver halide photographic material of the present invention is classified as an ion-conductive material or a fine electrically conductive powder.

The ion-conductive material is first described hereinafter. This may be defined as a material that displays electrical conductivity and which contains ions (anions or cations) as charge carriers. Examples of preferred ion-conductive materials are ionic high-molecular weight compounds and electrolyte-containing metal oxide sols.

Illustrative ionic high molecular weight compounds include: anionic high-molecular weight compounds (charge carriers being cations) such as those described in Japanese Patent Publication Nos. 23828/1974, 23827/1974 and 28937/1972; ionene polymers (charge carriers being anions) having a cationic dissociative group in the backbone chain, such as those described in Japanese Patent Publication No. 734/1980, Japanese Patent Application (OPI) No. 54672/1975, Japanese Patent Publication Nos. 14735/1984, 18175/1982, 18176/1982, and 56059/1982; and cationic pendant polymers (charge carriers being anions) having a cationic dissociative group in the backbone chain, such as those described in Japanese Patent Publication Nos. 13223/1978, 15376/1982, Japanese Patent Application (OPI) Nos. 45231/1978, 145783/1980, 65950/1980, 67746/1980, 11342/1982, 19735/1982 and Japanese Patent Publication No. 56858/1983.

Among these ionic high-molecular weight compounds, polymers with a cationic dissociative group wherein conductivity is imparted by anions are particularly preferable.

Preferable ionic high-molecular weight compounds are polymers having a structural unit of the following general formula (I) or (II):

(I)

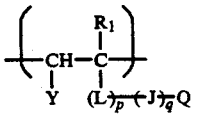

where $R_1$ is a hydrogen atom, an alkyl group having 1–4 carbon atoms, a halogen atom, or $—CH_2COO^{\ominus}M^{\oplus}$; Y is $—COO^{\ominus}M^{\oplus}$ or a hydrogen atom; L is —CONH—, —COO—, —CO— or —O—; J is a divalent group having a substituted or unsubstituted $C_{1-12}$ alkylene, arylene, alkylenearyl or arylenealkylene group; Q is a group having a cationic or anionic dissociative group, such as $—O^{\ominus}M^{\oplus}$, $—SO_3^{\ominus}M^{\oplus}$,

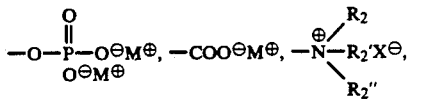

-continued

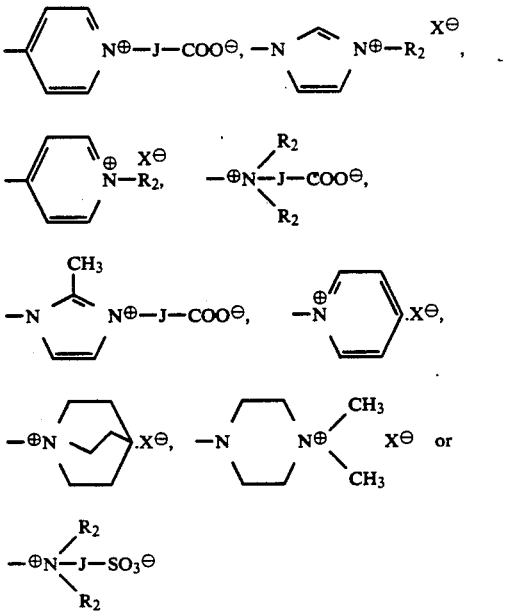

and a group having a cationic dissociative group with a quaternary nitrogen atom is preferable, with a group having $X^{\ominus}$ being particularly preferable; M is a hydrogen atom or a cation; $R_2$, $R_2'$ and $R_2''$ are each a substituted or unsubstituted $C_{1-4}$ alkyl group, preferably methyl, ethyl or propyl; p and q are each an integer of 0 or 1; and X is an anion;

(II-A)

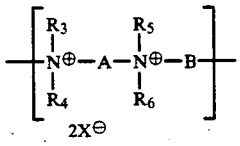

(II-B)

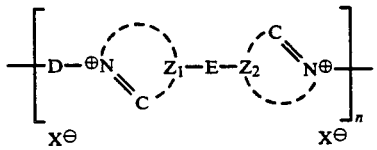

where $R_3$, $R_4$, $R_5$ and $R_6$ are each a substituted or unsubstituted $C_{1-4}$ alkyl group, provided that $R_3$ and $R_5$ and/or $R_4$ and $R_6$ may combine together to form a nitrogenous heterocyclic ring; A, B and D are each a substituted or unsubstituted $C_{2-10}$ alkylene (provided that the alkylene may be interrupted by an arylene group), arylene, alkenylene, arylenealkylene or alkylenearylene group, $—R_7COR_8—$, $—R_9COOR_{10}—OCOR_{11}—$, $—R_{12}OCOR_{13}—COOR_{14}—$, $—R_{15}(OR_{16})_m$, $—R_{17}CONHR_{18}NHCOR_{19}$, $—R_{20}OCONHR_{21}NHCOR_{22}$ or $—R_{23}NHCONHR_{24}—NHCONHR_{25}$, where $R_7$, $R_8$, $R_9$, $R_{11}$, $R_{12}$, $R_{14}$, $R_{15}$, $R_{16}$, $R_{17}$, $R_{19}$, $R_{20}$, $R_{22}$, $R_{23}$ and $R_{25}$ are each an alkylene group, and $R_{10}$, $R_{13}$, $R_{18}$, $R_{21}$ and $R_{24}$ are each a linkage selected from among a substituted or unsubstituted alkylene, alkenylene, arylene, arylenealkylene, and alkylenearylene group; m is an integer of 1–4; $X^{\ominus}$ is an anion, provided that when A is an alkylene, hydroxyalkylene or arylenealkylene group, it is preferable that B is not an alkylene, hydroxyalkylene or arylenealkylene group; E is a simple linkage, —NHCOR$_{26}$CONH— or a group illustrated for D; R$_{26}$ being a substituted or unsubstituted alkylene, alkenylene, arylene, arylenealkylene or alkylenearylene group; Z$_1$ and Z$_2$ each represents the non-metallic atomic group necessary to form a 5- or 6-membered ring together with the —N=C— group (said atomic group may be linked to E in the form of a quaternary salt of the formula ≡N$^{\ominus}$X$^{\oplus}$); n is an integer of 5–300.

Specific examples of the preferred ionic high-molecular weight compound having a structural unit of the formula (I), (II-A) or (II-B) are listed below.

Illustrative Ionic High-Molecular Weight Compounds Having a Structural Unit of Formula (II-A) or (II-B):

IP-1

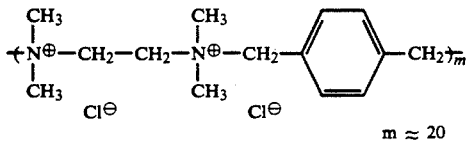

m ≈ 20

IP-2

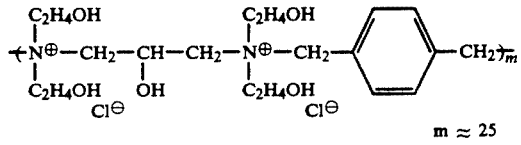

m ≈ 25

IP-3

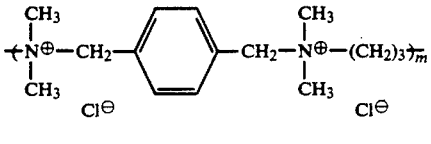

m ≈ 30

IP-4

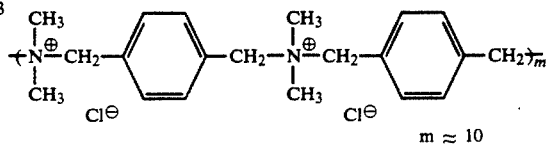

m ≈ 10

IP-5

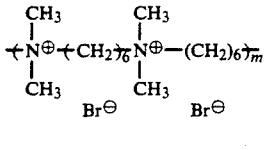

m ≈ 75

IP-6

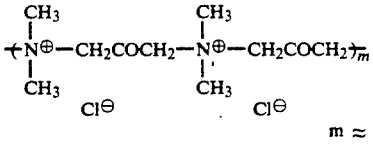

m ≈ 5

IP-7

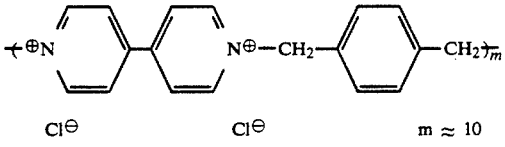

m ≈ 10

IP-8

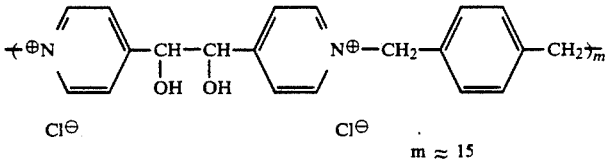

m ≈ 15

IP-9

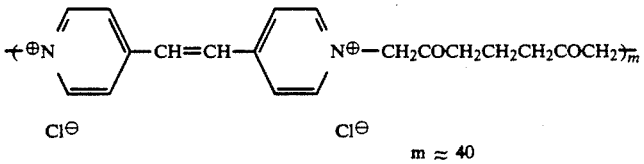

m ≈ 40

IP-10

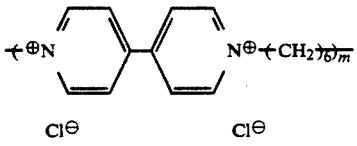

m ≈ 40

IP-11

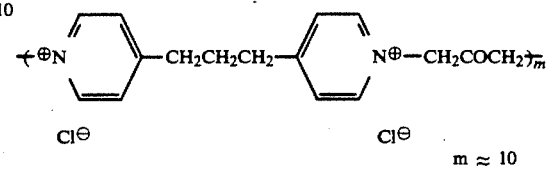

m ≈ 10

IP-12

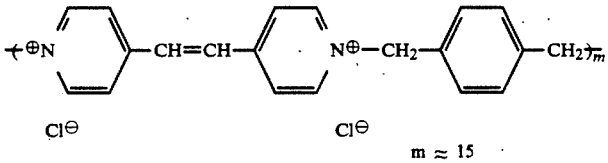

m ≈ 15

-continued
IP-13
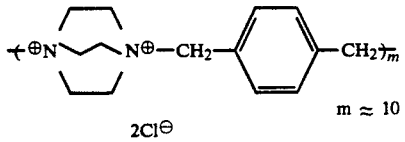
m ≈ 10
IP-14
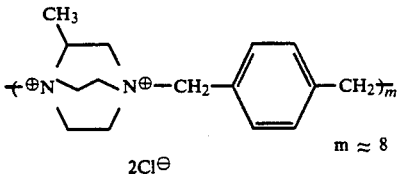
m ≈ 8
IP-15
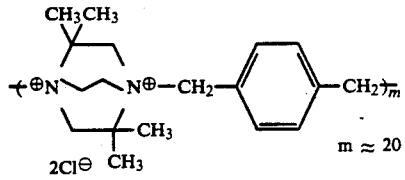
m ≈ 20
IP-16
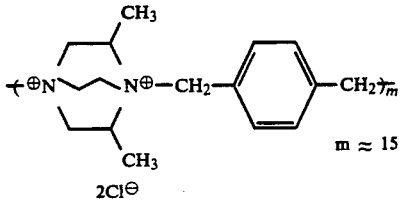
m ≈ 15
IP-17
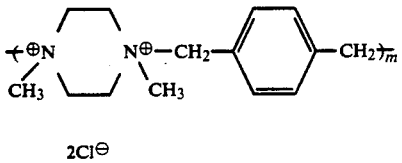
m ≈ 40
IP-18
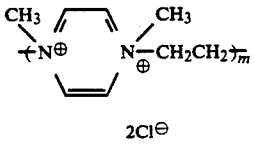
m ≈ 8
IP-19
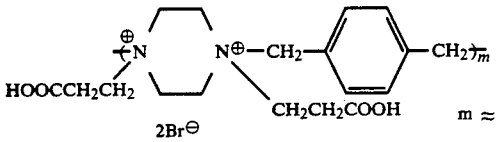
m ≈ 22
IP-20
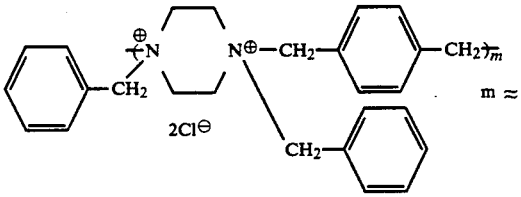
m ≈ 10
IP-21
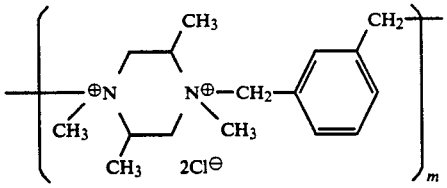
m ≈ 15
Illustrative Ionic High-Molecular Weight Compounds Having a Structural Unit or Formula (I):
IP-22
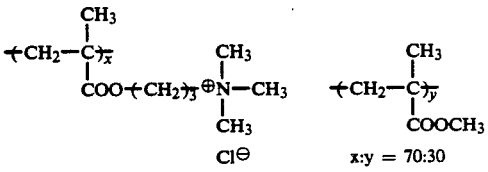
x:y = 70:30
IP-23
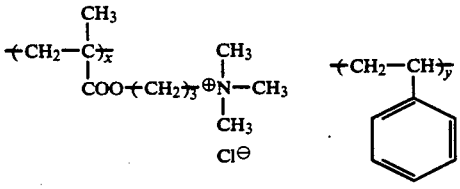
x:y = 60:40
IP-24
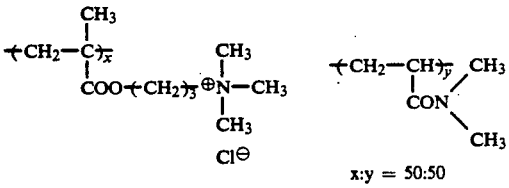
x:y = 50:50
IP-25
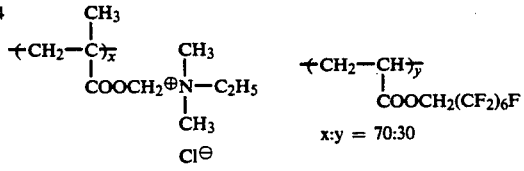
x:y = 70:30

-continued

IP-26

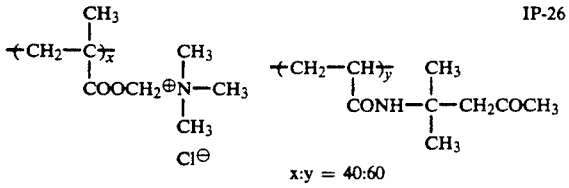

x:y = 40:60

IP-27

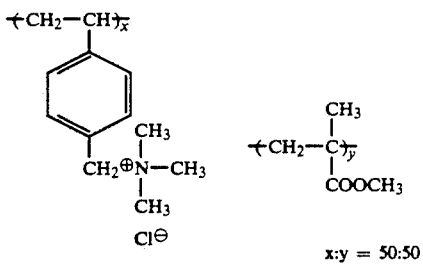

x:y = 50:50

IP-28

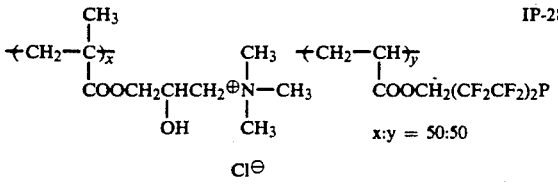

x:y = 50:50

IP-29

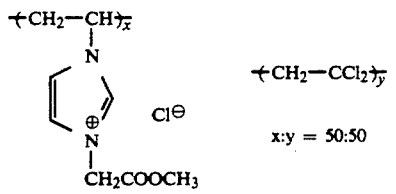

x:y = 50:50

IP-30

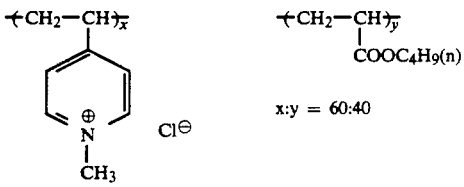

x:y = 60:40

IP-31

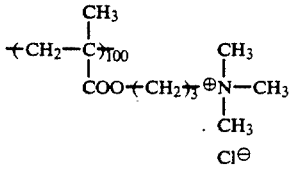

IP-32

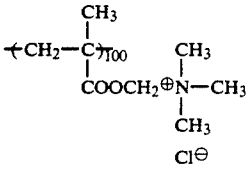

IP-33

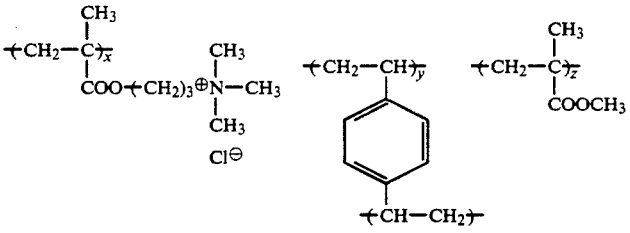

x:y:z = 50:4:46

IP-34

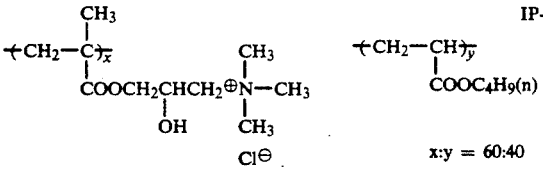

x:y = 60:40

IP-35

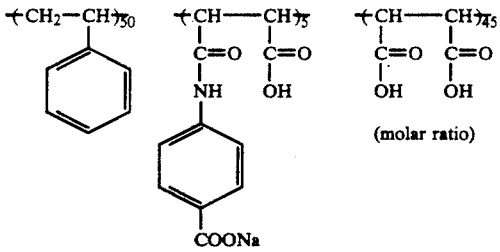

(molar ratio)

IP-36

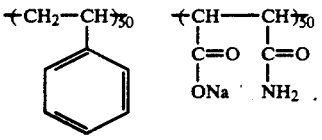

The ionic high-molecular weight compounds listed above may be used either independently or in combination. Such ionic high-molecular weight compounds are preferably used in amounts ranging from 0.005 to 2.0 g/m$^2$, with the range of 0.01–1.0 g/m$^2$ being particularly preferable.

The other preferred type of ion-conductive material is an electrolyte-containing metal oxide sol wherein electrical conductivity is imparted by anions. Useful electrolyte-containing metal oxide sols are alumina sols of the types described in Japanese Patent Application (OPI) Nos. 59926/1979, 126238/1980, 126239/1980 and 140834/1980. Such alumina sols contain aluminum oxide based colloidal particles and an electrolyte and may be prepared by any of the known methods such as the one described in Japanese Patent Publication No. 20150/1964, which comprises adding a metallic aluminum powder to an aqueous solution of hydrochloric acid and heating the mixture to undergo reaction. The alumina sol may be prepared from an aqueous solution of acetic acid or nitric acid by similar procedures.

Electrolytes that can be incorporated in the alumina sol include: inorganic acids such as hydrochloric acid, nitric acid, sulfuric acid and phosphoric acid; organic acids such as aliphatic carboxylic acids (e.g. formic acid, acetic acid and propionic acid) and aromatic carboxylic acids (e.g. cinnamic acid); and hydroxides and salts of alkali metals (e.g. sodium chloride, sodium acetate and sodium cinnamate). Preferable electrolytes are those which have an anion portion of a low molecular weight and inorganic acids are particularly desirable. The electrolyte is preferably used in an amount of $10^{-4}$ to $10^{-2}$ moles per gram of aluminum. The colloidal particles in the alumina sol generally have sizes within the range of 0.1–0.02 μm, and they are advantageously used in the present invention since the colloidal particles have a hydrate adsorbed onto their surfaces and will readily spread to form a continuous film.

Ionic high-molecular weight compounds that are preferable for use as electrically conductive materials in the present invention are those in which conductivity is imparted by anions, and those which have a quaternary nitrogen atom are more preferable.

The ion-conductive materials described above may be coated onto a support after they have been dissolved in water or a water-miscible organic solvent. Alternatively, they may be coated after being mixed with a hydrophobic polymer such as polystyrene or cellulose diacetate. Better results are attained by overlaying the coated layer of ion-conductive material with a layer formed of a hydrophobic polymer, which is preferably selected from among the materials that will not readily generate static electricity such as cellulose diacetate and polyvinyl acetal, rather than from those which are comparatively good generators of static electricity such as poly(vinyl acetate) and poly(vinylidene chloride).

The other class of electroconductive materials that may be used in the present invention are fine electroconductive powders. Preferable fine electroconductive powders are the particles of crystalline metal oxides, which contain either oxygen defects or minor amounts of dissimilar atoms that will serve as doners for the metal oxides used.

The fine electroconductive powders formed of crystalline metal oxides which are suitable for use in the present invention are typically prepared by the following methods: i) metal oxide particles are made by firing and then subjected to a heat treatment in the presence of a dissimilar atom that will provide improved electroconductivity; ii) fine metal oxide particles are made by firing in the presence of a dissimilar atom that will impart improved electroconductivity; and iii) metal oxide particles are made by firing with the oxygen concentration of the firing atmosphere being reduced to introduce oxygen defects.

The above-described fine electroconductive powders preferably have an average particle size of no more than 0.5 μm, with the average size of 0.3 μm or less being more preferable.

Useful metal oxides include ZnO, $TiO_2$, $SnO_2$, $Al_2O_3$, $In_2O_3$, MgO, BaO, $MoO_3$ and complexes thereof. Dissimilar metals serving as doners include Al and In for ZnO, Nb and Ta for $TiO_2$, and Sb, Nb and halogens for $SnO_2$.

Binders that can be used in forming layers containing the particles of these electroconductive metal oxides include: water-soluble polymers such as gelatin, gelatin derivatives, polyvinyl pyrrolidone, polyacrylic acid, carboxymethyl cellulose and hydroxyethyl cellulose; cellulose derivatives such as cellulose diacetate, cellulose triacetate, cellulose nitrate, cellulose acetate propiopate, and cellulose acetate phthalate; homopolymers or copolymers of vinyl chloride, vinylidene chloride, polystyrene, alkyl ($C_{1-4}$) acrylates, alkyl ($C_{1-4}$) methacrylates, vinyl acetate, ethylene, butadiene, hydroxylethyl acrylates and acrylamides; and maleic anhydride containing copolymers. The layers containing the particles of the aforementioned electroconductive metal oxides are preferably deposited in thicknesses ranging from 0.05 to 5 μm, more preferably from 0.1 to 3 μm.

The ratio of the electroconductive metal oxide to binder varies with the type of oxide and the size of its particles but is preferably within the range of from about 1:2 to 2:1 a volume basis.

The fine electroconductive powder is preferably used in the present invention in an amount ranging from 0.01 to 5.0 g/m$^2$, more preferably from 0.05 to 1 g/m$^2$.

Ion-conductive materials are preferably used as electroconductive materials in the present invention. More preferable ion-conductive materials are those in which electrical conductivity is imparted by anions, and ionic high-molecular weight compounds having a quaternary nitrogen atom are particularly preferable.

The silver halide photographic material of the present invention may contain matting agents, lubricants, plasticizers, anti-foamers, surfactants and other aids in the layer containing the electroconductive material specified above, as well as in any overcoat formed on that layer.

Useful matting agents are the particles of metal oxides (e.g. silicon oxide, aluminum oxide and magnesium oxide) having sizes of 0.1–5 μm, and polymeric beads of high-molecular weight compounds such as poly(methyl methacrylate) and methyl methacrylate/methacrylic acid copolymers.

The silver halide photographic material of the present invention has a layer containing an electroconductive material on one surface of the support, and at least one silver halide emulsion layer and the outermost layer on the other surface of the support.

An organopolysiloxane is contained in the outermost layer and it may be selected from among the compounds shown in many prior patents, such as U.S. Pat. Nos. 3,042,522, 3,080,317, 2,694,637, Japanese Patent Publication No. 15714/1964, British Patent Nos. 1,030,811, 1,143,118, 1,528,656, 1,275,657, 1,278,402, 1,313,384, Japanese Patent Publication Nos. 15740/1976, 34230/1970, 27428/1971, Japanese Patent Application (OPI) Nos. 62128/1974, 62127/1974, Japanese Patent Publication Nos. 292/1978, 49294/1980, Japanese Patent Application (OPI) Nos. 140341/1985, 140342/1985, 140343/1985, 188945/1985, 231704/1985, 231720/1985, 240761/1985, 243167/1985, 240732/1985, 245638/1985, 216/1986, 232/1986 and 260/1986. These compounds may be used either alone or in combination.

Among the organopolysiloxanes disclosed in the above-listed patents, those having a structural unit of the following formula (III) are preferred:

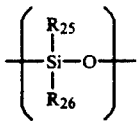

(III)

where $R_{25}$ is a hydrogen atom, a hydroxyl group or an organic group; $R_{26}$ is an organic group, provided that $R_{25}$ and $R_{26}$ may be the same or different.

Illustrative organic groups include alkyl, alkenyl, alkoxy, oxyalkylene, vinyl, aryl, aralkyl, and groups containing these groups. These groups may have substituents such as aryl, ether, amino, carbonyl, epoxy, mercapto, cyano and halogens.

It is also preferred that the organopolysiloxane is terminated with a structural unit of the following formula (IV):

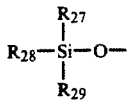

(IV)

where $R_{27}$, $R_{28}$ and $R_{29}$ are each a hydrogen atom, a halogen atom, a hydroxy group or an organic group, provided that $R_{27}$, $R_{28}$ and $R_{29}$ may be the same or different. Illustrative organic groups include alkyl, alkenyl, alkoxy, oxyalkylene, vinyl, aryl, aralkyl, and groups containing these groups. These groups may have substituents such as aryl, ether, amino, carbonyl, epoxy and carboxy.

The viscosity of the organopolysiloxane used in the outermost layer of the photographic material of the present invention is not limited to any particular value but is advantageously within the range of from about 20 to about 100,000 cSt at 25° C.

The molecular weight of the organopolysiloxane should be chosen depending upon the specific object of its use and is typically within the range of from 1000 to 1,000,000, preferably within the range of 2000–50,000.

Specific examples of the organopolysiloxane compound that is preferably used in the present invention are listed below but it should be understood that they are by no means given as limiting examples.

S-1

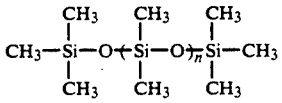

n = 370

S-2

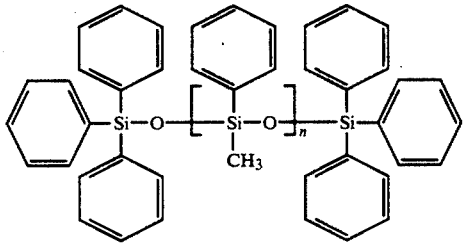

n = 10

S-3

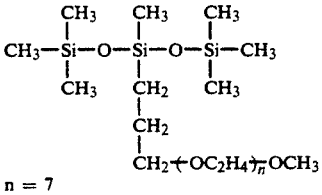

n = 7

S-4

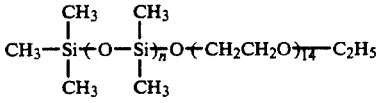

n = 5

S-5

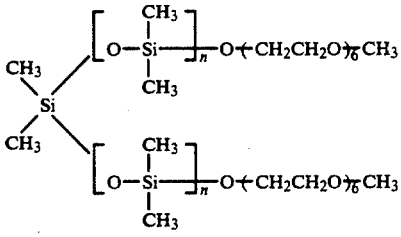

n = 2

S-6

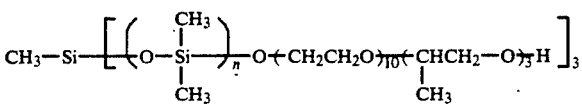

n = 2

-continued
S-7
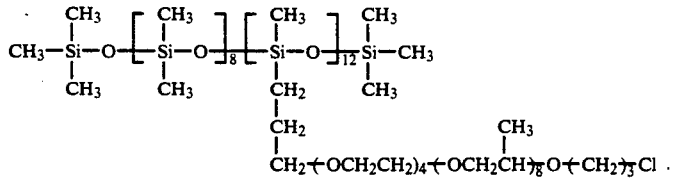
S-8
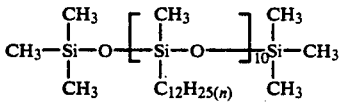
S-9
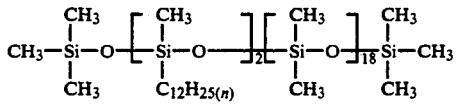
S-10
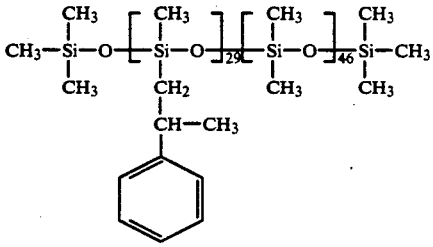
S-11
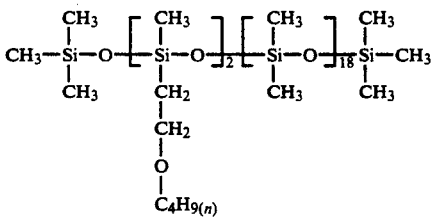
S-12
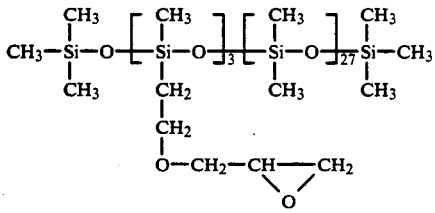
S-13
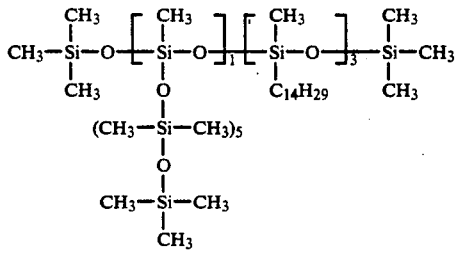
S-14
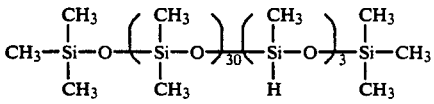
S-15
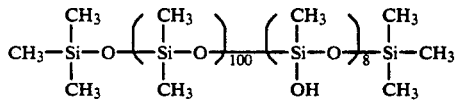
S-16
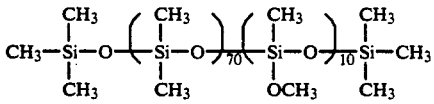
S-17
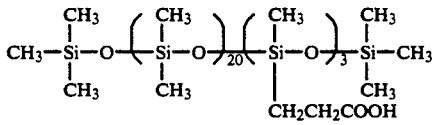
S-18
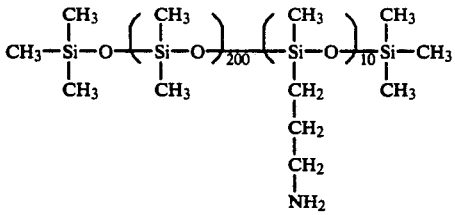
S-19
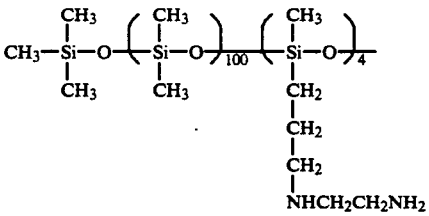
S-20
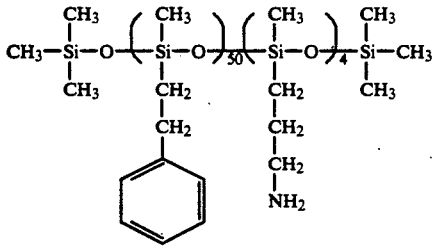
S-21
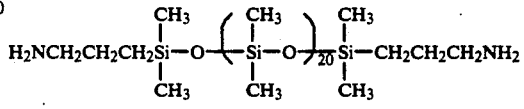

-continued
S-22
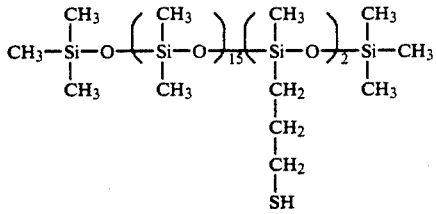
S-23
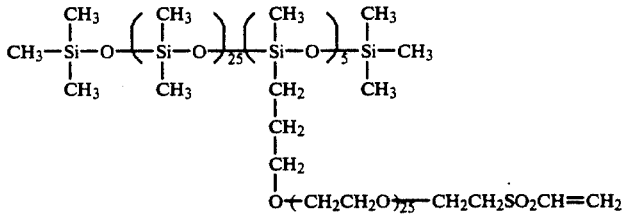
S-24
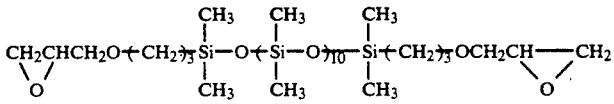
S-25
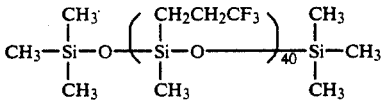
S-26
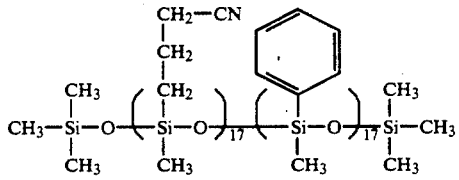
S-27
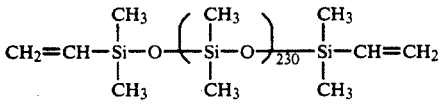
S-28
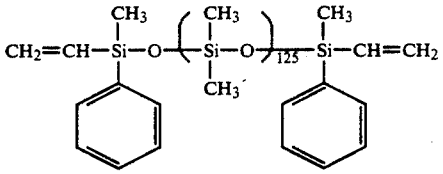
S-29
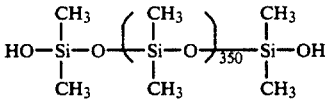
S-30
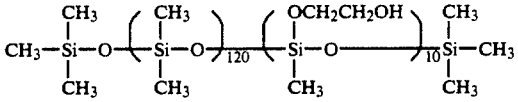
S-31
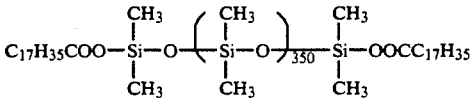
S-32
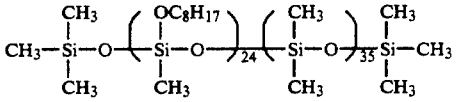
S-33
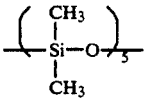
S-34
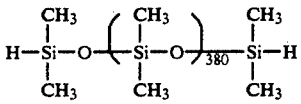
S-35
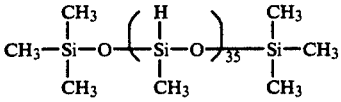
S-36
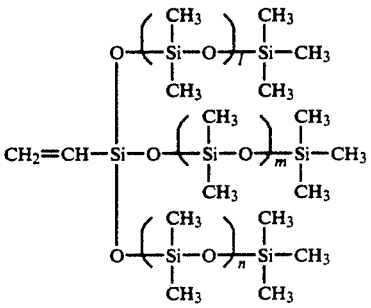
$l + m + n = 10 \sim 12$ -continued

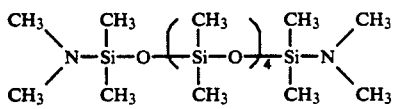

S-37

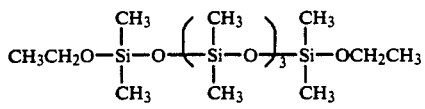

S-38

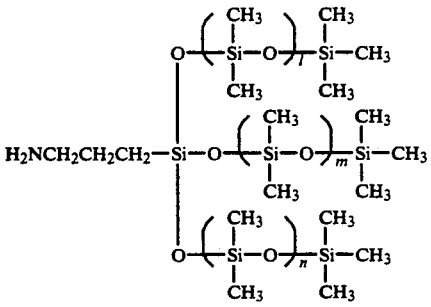

$l + m + n = 10 \sim 12$

S-39

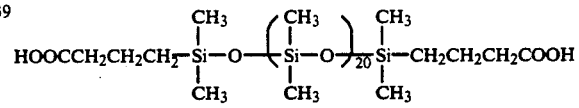

S-40

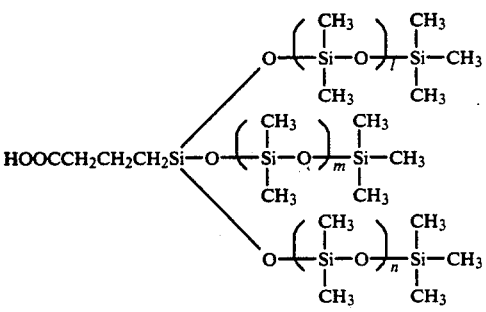

$l + m + n = 12 \sim 15$

S-41

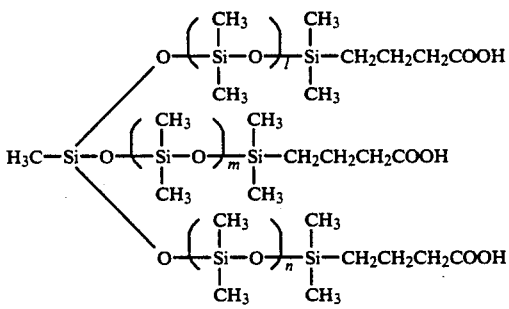

$l + m + n = 9 \sim 12$

S-42

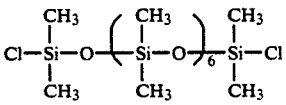

S-43

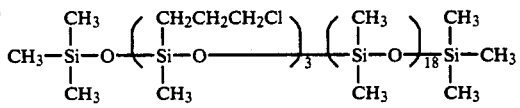

S-44

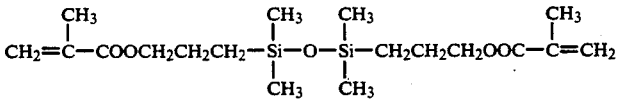

S-45

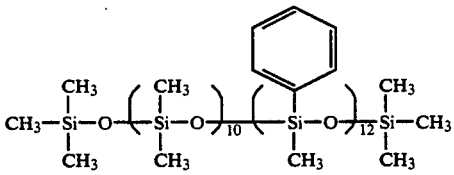

S-46

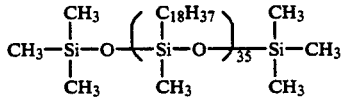

S-47

The organopolysiloxane is preferably used in the outermost layer of the photographic material of the present invention in an amount of 0.3–30 wt % of the water-soluble binder (e.g. gelatin) used.

In addition to the organopolysiloxane, a nonionic surfactant containing a polyoxyethylene unit and/or a fluorine-containing compound is incororated in the outermost layer of the silver halide photographic material of the present invention.

The nonionic surfactant having a polyoxyethylene unit that is suitable for use in the present invention (this surfactant is hereinafter referred to simply as a nonionic surfactant) is preferably selected from among the compounds of the following general formulas (N-I), (N-II) and (N-III):

$$R^1-A-(CH_2CH_2O)_{n1}-H \quad \text{(N-I)}$$

-continued (N-II)

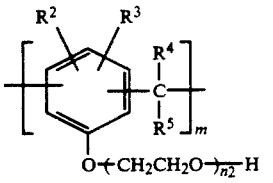

(N-III)

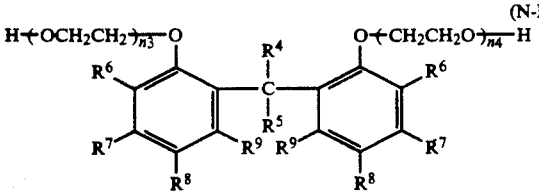

wherein $R^1$ is a hydrogen atom or an alkyl, alkenyl or aryl group having 1–30 carbon atoms, provided that these groups may have a substituent; $R^1$ is preferably an alkyl, alkenyl or aryl group having 4–24 carbon atoms, with hexyl, dodecyl, isostearyl, oleyl, t-butylphenyl, 2,4-di-t-butylphenyl, 2,4-di-t-pentylphenyl, p-dodecylphenyl, m-pentadecaphenyl, t-octylphenyl, 2,4-dinonylphenyl, and octylnaphthyl being particularly preferable; A is —O—, —S—, $$-\underset{\underset{R^{17}}{|}}{CON}-,$$

—COO—, —OCO—, $$-\underset{|}{N}-R^{10},\ -CO-\underset{|}{N}-R^{10}\ \text{or}\ -SO_2\underset{|}{N}R^{10}$$

(where $R^{10}$ is a hydrogen atom or an optionally substituted alkyl group; $R^{17}$ is a hydrogen atom, an alkyl group or $CH_2CH_2O)_{n5}H$; $R^2$, $R^3$, $R^7$ and $R^9$ are each a hydrogen atom, an alkyl group, an aryl group, an alkoxy group, an aryloxy group, a halogen atom, an acyl group, an amido group, a sulfonamido group, a carbamoyl group or a sulfamoyl group, these groups being optionally substituted; $R^6$ and $R^8$ are each an alkyl group, an aryl group, an alkoxy group, an aryloxy group, a halogen atom, an acyl group, an amido group, a sulfonamido group, a carbamoyl group or a sulfamoyl group, these groups being optionally substituted; $R^6$ and $R^8$ are preferably an alkyl groups with 1–20 carbon atoms, an aryl group such as phenyl or p-chlorophenyl, an alkoxy or aryloxy group of the formula $—OR^{15}$ (where $R^{15}$ is an alkyl or aryl group having 1–20 carbon atoms, these groups being optionally substituted as in the cases that follow), a halogen atom such as chlorine or bromine an acyl group of the formula $—COR^{15}$, an amido group of the formula $—NR^{16}COR^{15}$ (where $R^{16}$ is a hydrogen atom or an alkyl group having 1–20 carbon atoms as in the cases that follow), a sulfonamido group of the formula $—NR^{16}SO_2R^{15}$, a carbamoyl group of the formula $$-CON\begin{matrix}R^{16}\\R^{16}\end{matrix},$$

or a sulfamoyl group of the formula $$-SO_2\begin{matrix}R^{16}\\R^{16}\end{matrix},$$

with an alkyl group or a halogen atom being more preferable, and a tertiary alkyl group such as t-butyl, t-amyl or t-octyl being most preferable; $R^2$, $R^3$, $R^7$ and $R^9$ are preferably a hydrogen atom or one of the groups listed as preferable examples of $R^6$ and $R^8$, with $R^7$ and $R^9$ being a hydrogen atom in a particularly preferable case; $R^4$ and $R^5$ are each a hydrogen atom, an alkyl group, an aryl group or a furyl group, these groups being optionally substituted; particularly preferable examples of $R^4$ and $R^5$ are a hydrogen atom, an alkyl group having 1–8 carbon atoms, a phenyl group, and a furyl group; $R^4$ and $R^5$, $R^6$ and $R^7$, and $R^8$ and $R^9$ may combine together to form a ring, say, a cyclohexyl ring, provided that the phenyl ring in formula (N-III) may have a substituent that is symmetric with respect to the vertical center line; $n_1$, $n_2$, $n_3$, $n_4$ and $n_5$ each signifies the average number of moles of ethylene oxide added and is within the range of 3–50, preferably within the range of 5–30, provided that $n_3$ and $n_4$ may be the same or different; and m is an integer of 2–50.

The compounds of formulas (N-I), (N-II) and (N-III) may be found in U.S. Pat. Nos. 2,982,651, 3,428,456, 3,457,076, 3,454,625, 3,552,972, 3,655,387, Japanese Patent Publication No. 9610/1976, Japanese Patent Application (OPI) Nos. 29715/1978, 89626/1979, 203435/1983, 208743/1983, and "Shin-kaimenkasseizai (New Surfactants)", by H. Horiguchi, Sankyo Shuppan, 1975. Of the three types of compounds, those of formulas (N-II) and (N-III) are particularly preferred.

Specific examples of the nonionic surfactant that are preferably used in the present invention are given below:

$HO(CH_2CH_2O)_{12}H$ N-1

$HO(CH_2CH_2O)_{20}H$ N-2

$C_{17}H_{33}COO(CH_2CH_2O)_{15}H$ N-3

$C_8H_{17}O(CH_2CH_2O)_7H$ H-4

$C_{12}H_{25}O(CH_2CH_2O)_{10}H$ N-5

$C_{16}H_{33}O(CH_2CH_2O)_{12}H$ N-6

$C_{18}H_{35}O(CH_2CH_2O)_{16}H$ N-7

$C_{22}H_{45}O(CH_2CH_2O)_{25}H$ N-8

N-9

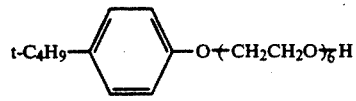

N-10

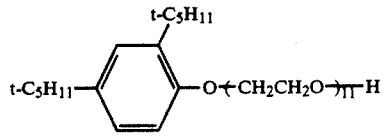

-continued
N-11
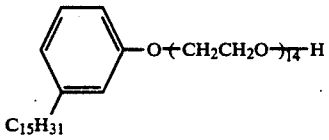
N-12
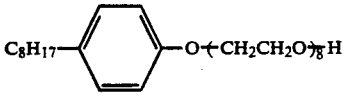
N-13
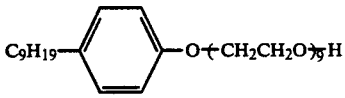
N-14
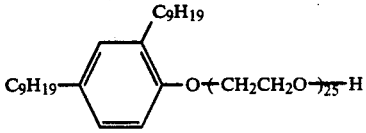
N-15
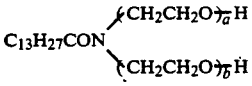
a + b = 15
N-16
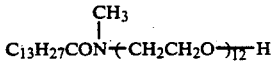
N-17
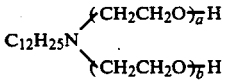
a + b = 20
N-18
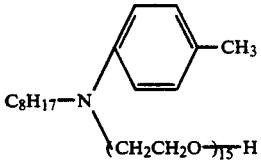
N-19
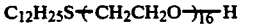
N-20
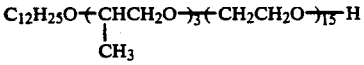
N-21
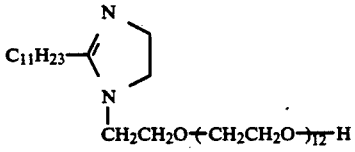
N-22
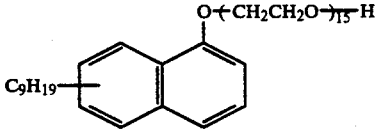
-continued
N-23
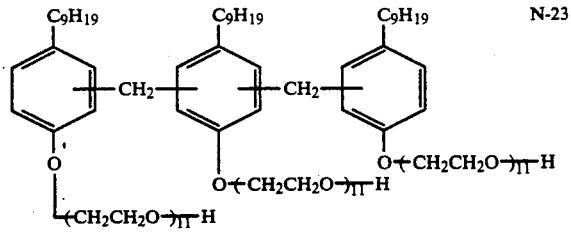
N-24
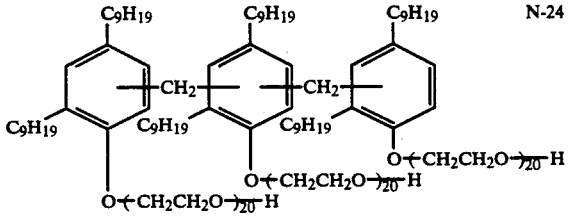
N-25
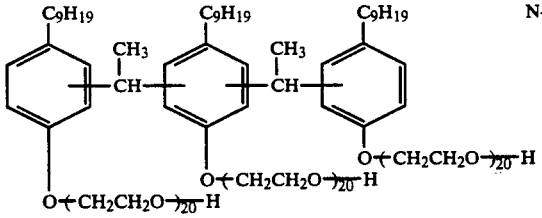
N-26
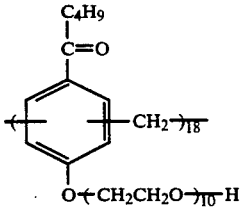
N-27
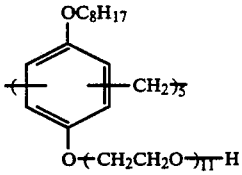
N-28
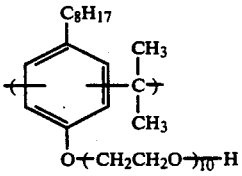
N-29
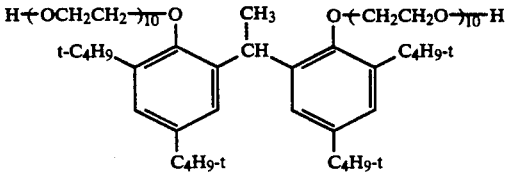

-continued
N-30
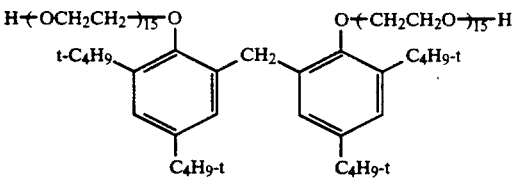
N-31
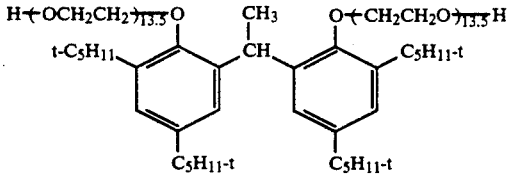
N-32
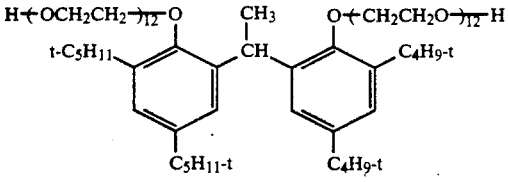
N-33
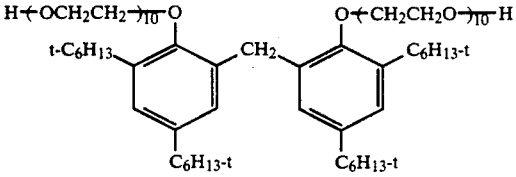
N-34
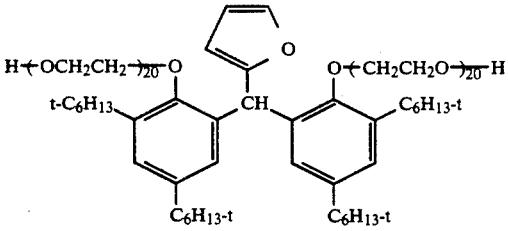
N-35
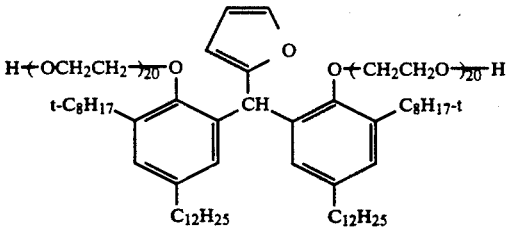
N-36
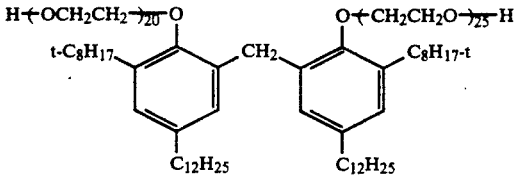
-continued
N-37
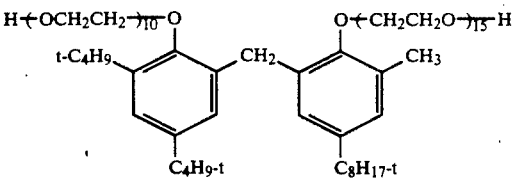
N-38
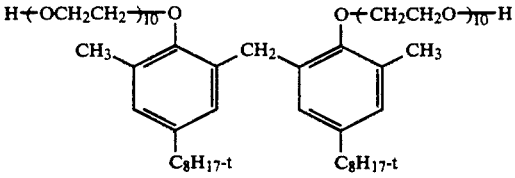
N-39
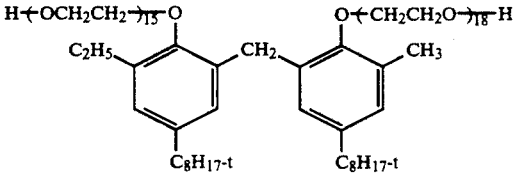
N-40
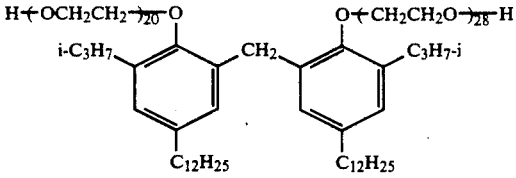
N-41
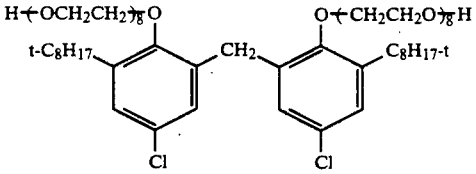
N-42
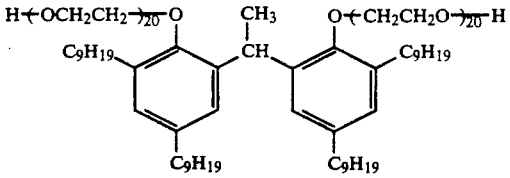
N-43
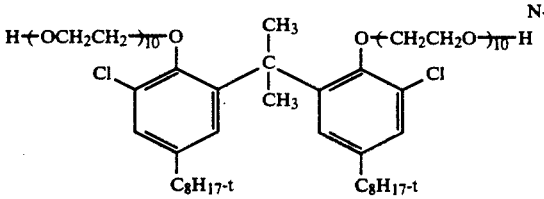
N-44
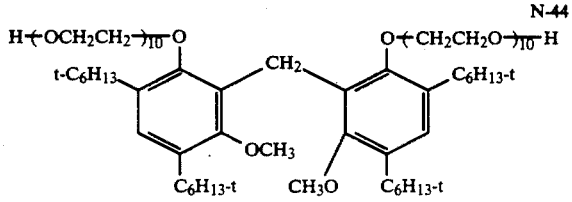

-continued

N-45

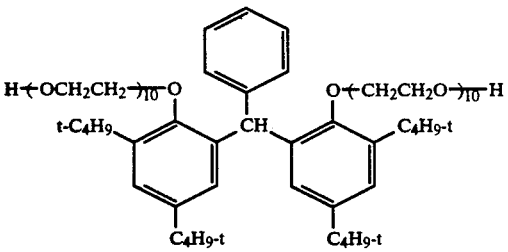

N-46

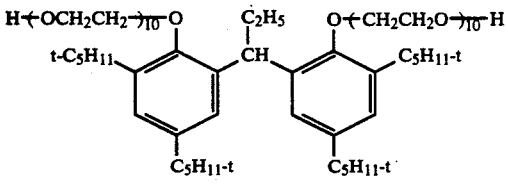

N-47

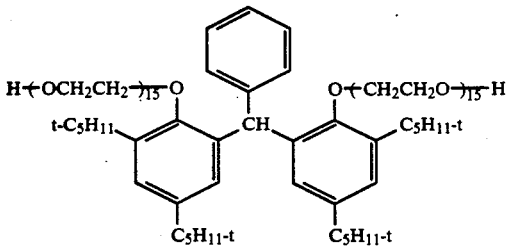

the outermost layer in which the nonionic surfactant is to be incorporated in accordance with the present invention is preferably a surface protective layer or an overcoat. The amount of nonionic surfactant used varies with the form or type of photographic material used or the coating method employed, but is typically within the range of 0.1–1,000 mg per square meter of the photographic material, with the range of 0.5–200 mg being particularly preferred.

The ratio of the amount of the organopolysiloxane to that of the nonionic surfactant used is preferably within the range of from 0.1:1 to 10:1.

The outermost layer of the photographic material of the present invention may contain a fluorine-containing compound in addition to the organopolysilocane and nonionic surfactant. Alternatively, in place of the nonionic surfactant, a fluorine-containing compound may be incorporated in the outermost layer in combination with the organopolysiloxane.

Examples of the fluorine-containing compound that may be incorporated in the outermost layer of the silver halide photographic material of the present invention include fluorine-containing surfactants and fluorine-containing polymers: the first class of compounds are described in such patents as British Patent Nos. 1,293,189, 1,259,398, U.S. Pat. Nos. 3,589,906, 3,666,478, 3,754,924, 3,775,236, 3,850,640, Japanese Patent Application (OPI) Nos. 48520/1979, 114944/1981, 161236/1975, 151127/1976, 59025/1975, 113221/1975, 999525/1975, Japanese Patent Publication Nos. 43130/1973, 44411/1981, 6577/1982, Japanese Patent Application (OPI) Nos. 200235/1983, 1965441/1983, 84712/1978, 64228/1982, 258542/1985, and in general references such as I & EC Product Research and Development, 1 (3), September 1962, and Abura Kagaku (Oil Chemistry), 12 (12), pp. 652–653; while compounds of the second class are described in such patents as Japanese Patent Application (OPI) Nos. 158222/1979, 129520/1977, 23828/1974, British Patent Nos. 1,352,975, 1,497,256, U.S. Pat. Nos. 4,087,394, 4,016,125, 3,240,604, 3,679,411, 3,340,216, 3,632,534, 30940/1973, 129520/1977, 44973/1985, 210613/1985, 11342/1982, 158222/1979, 76742/1985, 80849/1985, and U.S. Pat. No. 3,753,716.

Particularly preferable fluorine-containing compounds are the fluorine-containing surfactants of the following formula (F):

$$Rf-(A)_m-X \qquad (F)$$

where Rf is an alkyl group having at least 3 fluorine atoms (which may be substituted and is illustrated by dodecafluorohexyl or heptadecafluorooctyl), an alkyloxy group having at least 3 fluorine atoms (e.g. octylfluorooxy), an alkenyl group having at least 3 fluorine atoms (which may be substituted and is illustrated by heptafluorobutylene or tetradecafluorooctyl), an aryl group having at least 3 fluorine atoms (which may be substituted and is illustrated by trifluorophenyl or pentafluorophenyl), or an aryloxy group having at least 3 fluorine atoms (e.g. octylfluorophenyloxy); A is a divalent linking group; X is a hydrophilic group; and m is 0 or 1.

In formula (F), A is preferably an alkylene group (which may be substituted and is illustrated by ethylene or trimethylene), an arylene group (which may be substituted and is illustrated by phenylene), an alkylarylene group (which may be substituted and is illustrated by propylphenylene) or an arylalkylene group (which may be substituted and is illustrated by phenylethylene), these groups including in their category divalent linking groups that are interrupted by dissimilar atoms or groups such as an oxygen atom, an ester group, an amido group, a sulfonyl group and a sulfur atom.

In formula (F), X is a hydrophilic group and examples thereof include a nonionic group that may be illustrated by a polyoxyalkylene group of the formula $-(B-O)_nR_1$ where B is $-CH_2-CH_2-$, $-CH_2-CH_2-CH_2-$, $$-CH_2-\underset{\underset{OH}{|}}{CH}-CH_2 \quad \text{or} \quad -\underset{\underset{CH_3}{|}}{CH}-CH_2-;$$

n signifies the average degree of polymerization of the polyoxyalkylene group and is an integer of 1–50; $R_1$ is a hydrogen atom, an optionally substituted alkyl group, or an optionally substituted aryl group), a hydrophilic betaine group that may be represented by $$-\overset{\oplus R_2}{\underset{\underset{R_3}{|}}{N}}-R_4-COO^{\ominus} \quad \text{or} \quad -\overset{\oplus R_2}{\underset{\underset{R_3}{|}}{N}}-R_4-SO_3^{\ominus}$$

(where $R_4$ is an alkylene group having 1–5 carbon atoms, such as methylene, ethylene, propylene or butylene; $R_2$ and $R_3$ are each an optionally substituted $C_{1-8}$ alkyl group such as methyl or ethyl, or an optionally substituted aryl group such as benzyl), a hydrophilic cationic group that may be represented by

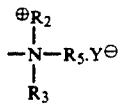

(where $R_2$, $R_3$ and $R_5$ are each the same as defined for $R^2$; $Y^{\ominus}$ is an anion such as in the form of a hydroxyl group, a halide group, a sulfuric acid group, a carbonic acid group, a perchloric acid group, an organic carboxylic acid group, an organic sulfonic acid group, or an organic sulfuric acid group), and a hydrophilic anionic group that may be represented by $-SO_3M-$, $-OSO_3M-$, $-COOM$,

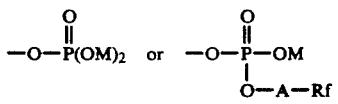

(where M is an inorganic or organic cation which is preferably a hydrogen atom, an alkali metal, an alkaline earth metal, ammonium or an alkylamine having 1-3 carbon atoms; A and Rf are each the same as defined above). Preferable examples of the hydrophilic group that is represented by X include nonionic, hydrophilic betaine and hydrophilic anionic groups, with the hydrophilic anionic group being particularly preferable.

Fluorine-containing polymers are also preferable for use as the fluorine-containing compound to be incorporated in the outermost layer of the photographic material of the present invention. The monomer units having a fluorine atom from which the fluorine-containing polymers are formed are preferably those which are derived from F-containing vinyl monomers, as well as those prepared by allowing a fluorinated alcohol to react with polymerized maleic anhydride; such monomer units are represented by the following general formula (F-I), (F-II) or (F-III).

In addition to the monomer units containing a fluorine atom, monomer units that are derived from other monomers copolymerizable with those basic monomer units may be present in the fluorine-containing polymers to such an extent that the objects of the present invention will not be impaired. Formulas (F-I), (F-II) and (F-III) are noted below:

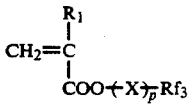

(F-I)

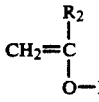

(F-II)

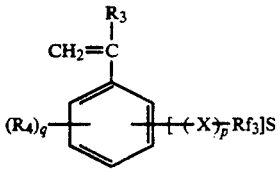

(F-III)

where $R_1$ and $R_2$ each signifies a hydrogen atom or a methyl group that may be substituted by a fluorine atom; $Rf_2$ is a straight-chained, branched or cyclic alkyl group that is substituted by a fluorine atom, said alkyl group preferably having 1-10 carbon atoms and optionally containing a non-fluorine substituent such as a hydroxyl group or a halogen atom (e.g. Cl or Br), provided that the carbon chain of the alkyl group represented by $Rf_2$ may be interrupted by a linking group such as oxo, thio or carbonyl; $R_3$ is a hydrogen atom, a chlorine atom or an alkyl group having 1-3 carbon atoms; $R_4$ is a univalent substituent and if q is 2 or greater, two or more $R_4$ may combine with each other to form a ring; $Rf_3$ is an alkyl, arylalkyl, aryl or alkylaryl group with 1-30 carbon atoms in which at least one hydrogen atom is replaced by a fluorine atom; X is a divalent linking group of the formula $-(R)_t-L-$ or $-L-(R)_t-$ [where R is a $C_{1-10}$ alkylene, arylene or aralkylene group; —L— is —O—, —S—, —NH—, —CO—, —OCO—, —CO—O—, —SCO—, —CONH—, —NHCO—, $-SO_2-$, $-NR^5SO_2-$ (where $R^5$ is a hydrogen atom or an alkyl group having 1-4 carbon atoms), $-SO_2NH-$, —SO— or $-OPO_2-$; t is 0 or 1]; q is an integer of 0-4; p is an integer of 0-4; and s is an integer of 1-5.

Typical and specific examples of fluorine-containing vinyl monomers of formula (F-I), (F-II) or (F-III) that are preferably used in the present invention are given below under the headings of FM-1 to FM-41:

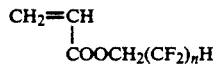

(n = integer of 2-9) FM-1

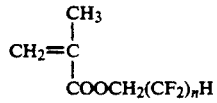

(n = integer of 2-9) FM-2

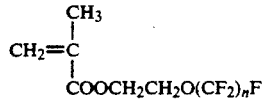

(n = integer of 2-8) FM-3

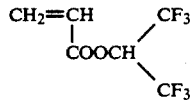

FM-4

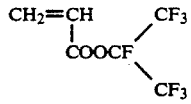

FM-5

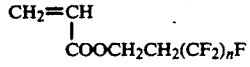

(n = integer of 2-8) FM-6

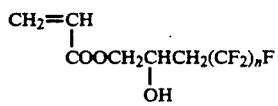

(n = integer of 2-8) FM-7

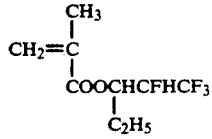

FM-8

-continued
FM-9
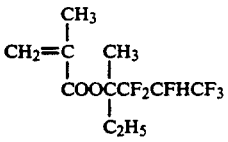
FM-10
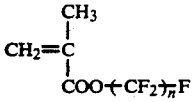
(n = integer of 2–8)
FM-11
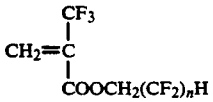
(n = integer of 2–9)
FM-12
$CH_2{=}CH{-}O{-}CH_2{-}(CF_2)_nH$
(n = integer of 2–8)
FM-13
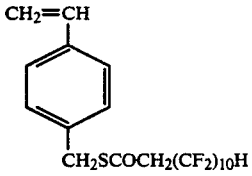
FM-14
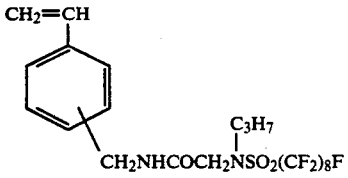
FM-15
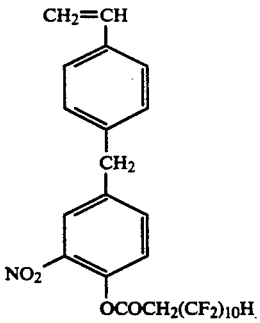
FM-16
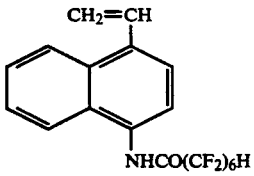
FM-17
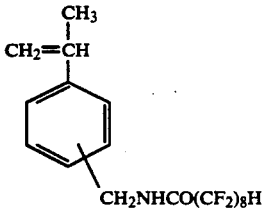
-continued
FM-18
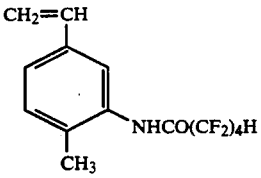
FM-19
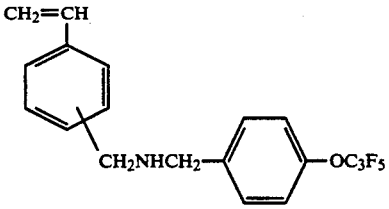
FM-20
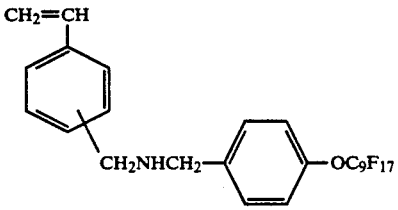
FM-21
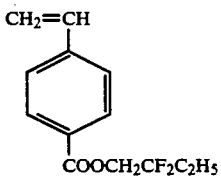
FM-22
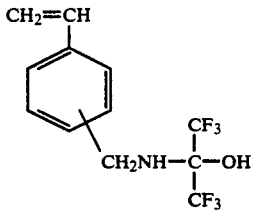
FM-23
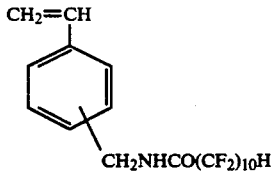
FM-24
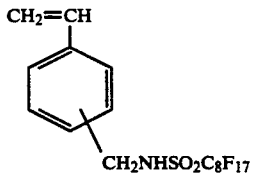
FM-25
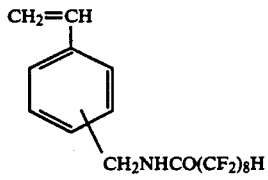

-continued

FM-26

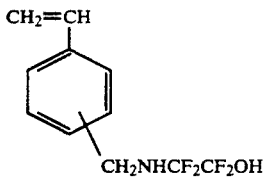

FM-27

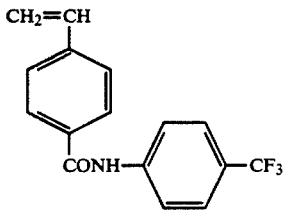

FM-28

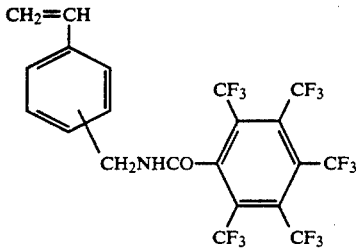

FM-29

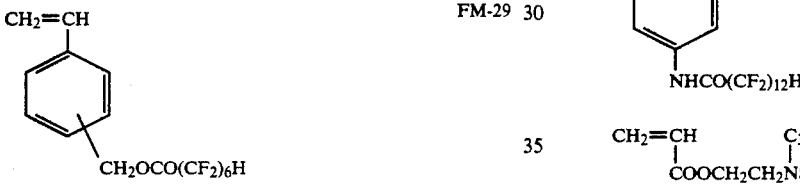

FM-30

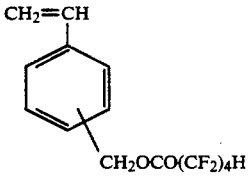

FM-31

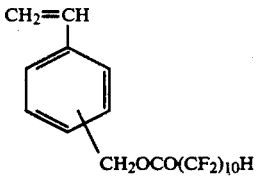

FM-32

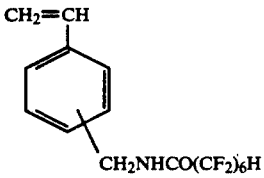

FM-33

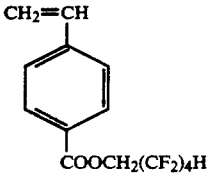

-continued

FM-34

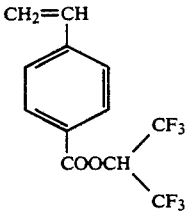

FM-35

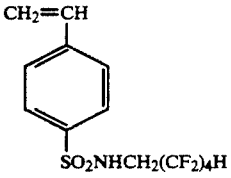

FM-36

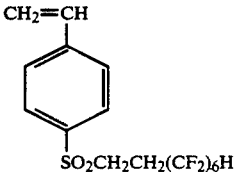

FM-37

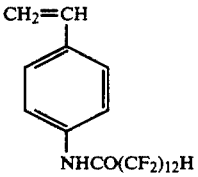

FM-38

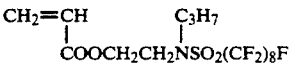

FM-39

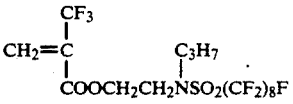

FM-40

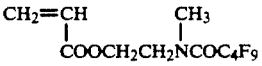

FM-41

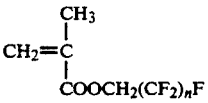

(n = integer of 2-9)

Illustrative monomers that are copolymerizable with monomers containing a fluorine atom include: acrylic acid (or salts thereof), methacrylic acid (or salts thereof), maleic acid (or salts thereof), alkyl acrylamidosulfonic acids (or salts thereof), acrylamide, vinyl pyrrolidone, vinyl pyridine, acrylic acid esters, methacrylic acid esters, vinyl esters, vinyl ether, vinyl ketone, styrene, acrylonitrile, vinyl chloride, vinylidene chloride, and olefins.

These monomers may have substituents. If the monomers containing a fluorine atom present in the fluorine-containing polymer used in the present invention do not have any hydrophilic group, the monomers listed above preferably contain substituents with hydrophilic groups, such as nonionic, hydrophilic betaine, hydrophilic cationic or hydrophilic anionic groups, each being signified by X in formula (F)noted above.

As will be understood from the foregoing description, the fluorine-containing compounds used in the present invention include fluorine-containing polymers in their scope, and fluorine-containing compounds that are preferably used in the present invention are those which have a hydrophilic group selected from among a nonionic group, a hydrophilic betaine group and a hydrophilic anionic group in their molecular structure (if the compound is a copolymer, in at least one of the structural formulas of the recurring units of the copolymer). It is particularly preferable to use fluorine-containing compounds having a hydrophilic anionic group.

Typical examples of the fluorine-containing compound that may be used in the present invention are specifically shown below:

$C_7F_{15}COOH$ F-1

$H\text{-}(CF_2)_8\text{-}CH_2COCH_2NH_2$ F-2

$C_8F_{17}SO_3K$ F-3

$C_8F_{17}SO_2N(C_3H_7)\text{-}CH_2COOK$ F-4

$H\text{-}(CF_2)_6\text{-}COOCH_2CH_2CH_2SO_3Na$ F-5

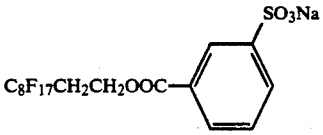

F-6

$C_8F_{17}CON(CH_3)\text{-}CH_2CH_2SO_3Na$ F-7

$H\text{-}(CF_2)_6\text{-}CH_2OOC\text{-}CH_2$
$H\text{-}(CF_2)_6\text{-}CH_2OOC\text{-}CH(\text{-}SO_3Na)$ F-8

$H\text{-}(CF_2)_8\text{-}CH_2O\text{-}(CH_2CH_2O)_p\text{-}OC\text{-}CH_2$
$H\text{-}(CF_2)_8\text{-}CH_2O\text{-}(CH_2CH_2O)_p\text{-}OC\text{-}CH(\text{-}CH_2SO_3K)$ F-9
p: 3 on average $C_8F_{17}SO_2N(C_3H_7)\text{-}(CH_2CH_2O)_p\text{-}(CH_2)_4\text{-}SO_3Na$ F-10
p: 4 on average $C_8F_{17}SO_2N(C_3H_7)\text{-}(CH_2CH_2O)_p\text{-}(CH_2)_3\text{-}SO_3Na$ F-11
p: 7 on average $C_{10}F_{21}CH_2CH_2O\text{-}(CH_2CH_2O)_p\text{-}(CH_2)_4\text{-}SO_3Na$ F-12
p: 6 on average $C_8F_{17}SO_2N(C_3H_7)\text{-}CH_2CH_2O\text{-}P(=O)(ONa)\text{-}ONa$ F-13

$[C_8F_{17}SO_2N(C_3H_7)\text{-}(CH_2CH_2O)_p]_2\text{-}P(=O)\text{-}ONa$ F-14
p: 5 on average $C_8F_{17}SO_2N(C_3H_7)\text{-}CH_2CH_2OSO_3Na$ F-15

$H\text{-}(CF_2)_8\text{-}CH_2O\text{-}(CH_2CH_2O)_{n5}\text{-}H$ F-16
n5: 10

$C_8F_{17}CH_2CH_2O\text{-}(CH_2CH_2O)_{n5}\text{-}H$ F-17
n5: 12

$C_8F_{17}SO_2N(C_3H_7)\text{-}(CH_2CH_2O)_{n5}\text{-}H$ F-18
n5: 11

-continued

F-19

$$C_8F_{17}SO_2NHCH_2CH_2-\overset{\oplus}{\underset{CH_3}{\overset{CH_3}{N}}}-CH_2COO^{\ominus}$$

F-20

$$C_8F_{17}SO_2\overset{CH_3}{\overset{|}{N}}-(CH_2CH_2O)_8-SO_3Na$$

F-21

$$C_4F_9-(CH_2CH_2O)_3-SO_3Na$$

F-22

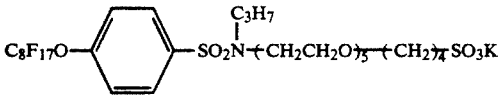

F-23

$$\begin{array}{l} C_6F_{13}SO_2\overset{C_3H_7}{\overset{|}{N}}-(CH_2CH_2O)_2-\overset{O}{\overset{\|}{C}}-CH_2 \\ C_6F_{13}SO_2\overset{C_3H_7}{\overset{|}{N}}-(CH_2CH_2O)_2-\overset{O}{\overset{\|}{C}}-\underset{|}{CH}-SO_2Na \end{array}$$

F-24

$$H-(CF_2)_8-CH_2O-(CH_2CH_2)_4-(CH_2)_3-SO_3H$$

F-25

$$C_7F_{15}COO-(CH_2CH_2O)_4-(CH_2)_4-SO_3K$$

F-26

$$C_8F_{17}SO_2\overset{C_3H_7}{\overset{|}{N}}-(CH_2CH_2O)_6-CH_2COONa$$

F-27

$$H-(CF_2)_8-CH_2O-(CH_2CH_2O)_3-\overset{O}{\overset{\|}{P}}(ONH_4)_2$$

F-28

$$C_8F_{17}SO_2\overset{C_3H_7}{\overset{|}{N}}-(CH_2CH_2O)_4-\overset{O}{\overset{\|}{P}}(ONa)_2$$

F-29

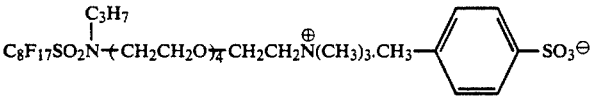

F-30

$$C_8F_{17}SO_2NHCH_2CH_2OCH_2CH_2CH_2-\overset{\oplus}{\underset{CH_3}{\overset{CH_3}{N}}}-CH_2COO^{\ominus}$$

F-31

$$C_7F_{15}CONH-CH_2CH_2CH_2-\overset{\oplus}{\underset{CH_3}{\overset{CH_3}{N}}}-(CH_2)_4-SO_3^{\ominus}$$

F-32

$$C_8F_{17}SO_2NHCH_2CH_2OCH_2CH_2CH_2-\overset{\oplus}{\underset{CH_3}{\overset{CH_3}{N}}}-(CH_2)_4-SO_3^{\ominus}$$

F-33

$$C_8F_{17}SO_2\overset{C_3H_7}{\overset{|}{N}}-CH_2CH_2-\overset{\oplus}{N}(CH_3)_3.Cl^{\ominus}$$

F-34

$$C_8F_{17}SO_2NH-(CH_2)_3-\overset{\oplus}{N}(CH_3)_3.I^{\ominus}$$

F-35

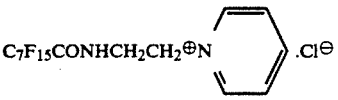

-continued
F-36
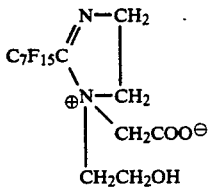
F-37
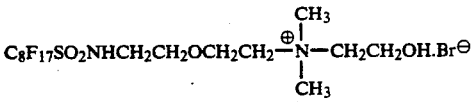
F-38
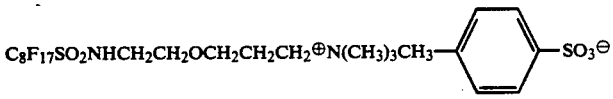
F-39
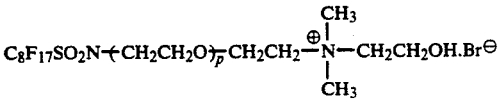
p: 4 on average
F-40
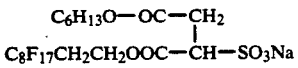
F-41
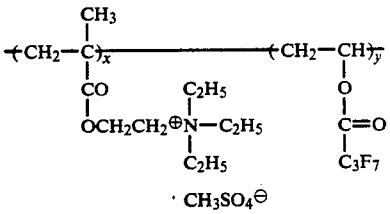
x:y = 80:20 (by molar ratio as in the cases that follow)
F-42
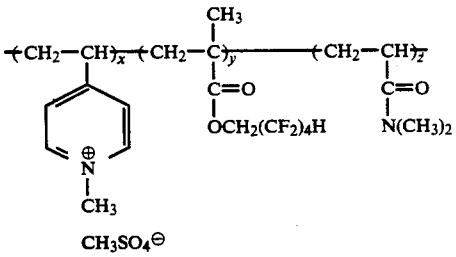
x:y:z = 70:20:10
F-43
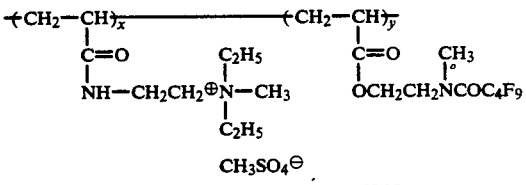
x:y = 65:35
F-44
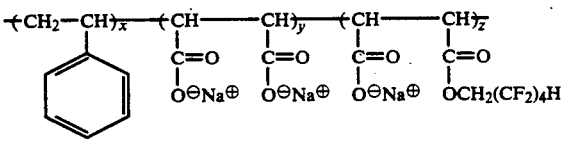
x:y:z = 50:20:30

-continued
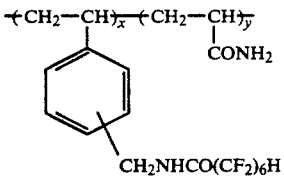
x:y = 2.1:97.9
F-46
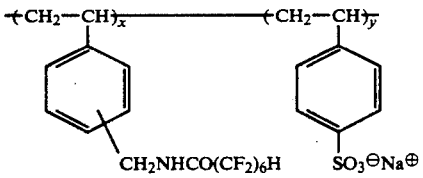
x:y = 35:65
F-47
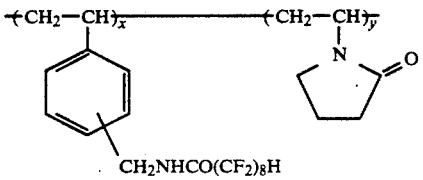
x:y = 3.7:96.3
F-48
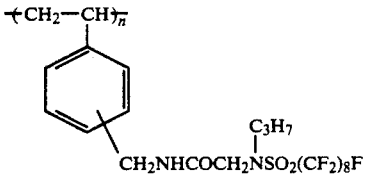
(water-dispersed latex)
F-49
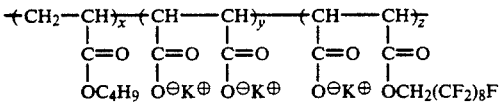
x:y:z = 50:20:30
F-50
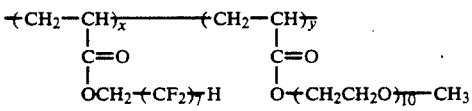
x:y = 40:60
F-51
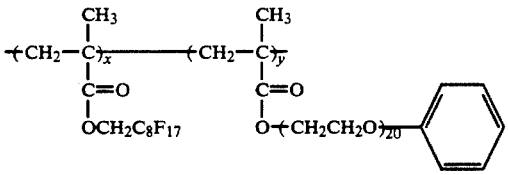
x:y = 70:30
F-52
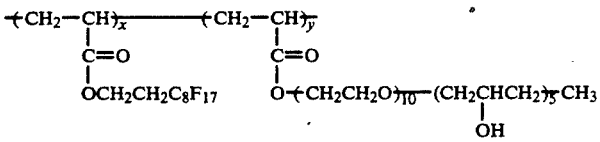
x:y = 50:50
F-53
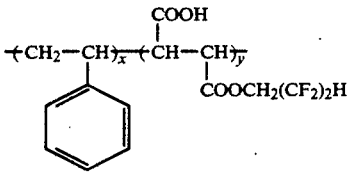

-continued x:y = 50:50

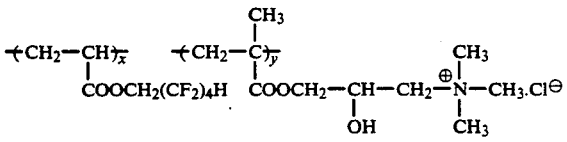

F-54 x:y = 50:50

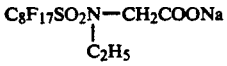

F-55

The fluorine-containing compound is incorporated in the outermost layer of the photographic material of the present invention in an amount which generally ranges from 0.5 to 500 mg/m$^2$, preferably in an amount of 1-100 mg/m$^2$. The ratio of the amount of the organopolysiloxane to that of the fluorine-containing compound is preferably within the range of from 0.5:1 to 50:1.

As described in the foregoing pages, the outermost layer of the silver halide photographic material of the present invention contains the organopolysiloxane and the nonionic surfactant having a polyoxyethylene unit, the latter being optionally combined with, or replaced by the fluorine-containing compound. The nonionic surfactant having a polyoxyethylene unit is effective in satisfactorily preventing the occurrence of static marks in a humid atmosphere. The fluorine-containing compound is effective in minimizing the time-dependent deterioration of electroconductivity. In a preferred embodiment, the nonionic surfactant may be used together with the fluorine-containing compound and they attain their own advantages simultaneously without causing any adverse effects on other characteristics.

If the nonionic surfactant having a polyoxyethylene unit is used in combination with the fluorine-containing compound, satisfactory results will be attained by controlling the proportions of the organopolysiloxane, surfactant and fluorine-containing compound to be within the range of 1:(0.1-5):(0.5-20).

The silver halide photographic material of the present invention is preferably stored in a condition having a relative humidity of no more than 55%. The photographic material can be said to have been stored in a condition having a relative humidity of A% if $\Delta W$ ($=W_2-W_1$) is zero, where $W_1$ is the weight of the photographic material that is measured within 30 seconds after it has been transferred from the stored condition to a condition having a relative humidity of A% at 25° C., and $W_2$ is the weight of the photographic material that is measured following 3 days of storage in the condition of A% r.h. at 25° C. If $\Delta W$ is negative, one can say that the photographic material was stored in a condition having a relative humidity exceeding A%, while the material was stored at a relative humidity of less than A% if $\Delta W$ is positive.

It is more preferable to store the photographic material of the present invention at a relative humidity of 55-30%, with the range of 55-35% being particularly preferable.

While various methods may be employed to store the silver halide photographic material of the present invention at a relative humidity of no more than 55%, the use of hermetic package is preferable. Hermetic packaging means the use of moisture-proof packages that are popular in the area of ordinary packaging. Various packaging materials may be employed and they include: metals and metal foils such as aluminum sheets, tin-plated steel sheets and aluminum foils; glass; high-molecular weight materials such as polyethylene, polyvinyl chloride, polystyrene, polyvinylidene chloride, polypropylene, polycarbonates and polyamides; and composite laminates in which various polymers are combined with other materials such as Cellophane, paper and aluminum foils.

Sealing of the packages may be accomplished by various methods such as the use of adhesives, hot melting (e.g. heat sealing), and confinement in cartridge cases that are commonly employed in the photographic industry. For details of these and other sealing methods, see, for example, "Handbook of Food Packaging Technology", ed. by the Society of Packaging Technology of Japan, pp. 573-609.

If the silver halide photographic material of the present invention is an imaging light-sensitive material in roll form, it is preferably confined in a cartridge case that is made of a high-molecular weight material such as polyethylene or polypropylene. If the photographic material is an imaging material in a sheet form, it is preferably packaged with heat-sealed polyethylene. These packaging methods may be applied twice to achieve dual hermetic packaging.

The silver halide photographic material of the present invention may be packaged at reduced relative humidities by a variety of methods: for instance, the photographic material may be packaged in a low-humidity area; in another method, the photographic material is dried by a greater degree than is usually effected; in still another method, a low-humidity condition may be attained by putting a desiccant such as a silica gel in the container to be hermitically sealed.

According to the present invention, the silver halide photographic material is stored in a dry condition at a relative humidity of 55% or less in order to lower the water content of the photographic material. This is a preferred embodiment of the invention since the various problems that have been encountered in using antistats in combination with slip agents, such as the formation of scum in processing solutions, and deterioration of the antistatic performance and slip properties in the processed photographic material, can be effectively solved.

Silver halide photographic materials are highly susceptible to static marks and other troubles associated with static electricity if they are stored under low-humidity conditions. However, such troubles are virtually absent from the silver halide photographic material of the present invention since a layer containing an electroconductive substance is formed on one surface of the support whereas an organopolysiloxane and a nonionic surfactant having a polyoxyethylene unit and/or a fluorine-containing compound are incorporated in the outermost layer that is situated on the other surface of the support carrying a silver halide emulsion layer.

In order to provide a greater assurance for preventing the occurrance of static marks and other troubles due to static buildup, a matting agent is preferably incorporated in the outermost layer on the side of the support where an emulsion layer is situated. Any of the known matting agents may be employed and they include, for example, silicon dioxide, titanium dioxide, magnesium dioxide, aluminum dioxide, barium sulfate, calcium carbonate, acrylic acid or methacrylic acid polymers and esters thereof, polyvinyl resins, polycarbonates, as well as styrene polymers and copolymers. The matting agents are preferably in the form of particles having a size of 0.05–10 μm. The matting agents are preferably incorporated in amounts of 1–300 mg/m$^2$.

The silver halide emulsion layer in the photographic material of the present invention may contain any of the known silver halides that are commonly employed in conventional silver halide emulsion layers. The silver halide emulsion may be chemically sensitized by any routine method. Alternatively, it may be optically sensitized for a desired wavelength region using any of the dyes that are generally known as sensitizing dyes in the photographic industry.

The binder (or protective colloid) advantageously used in the silver halide emulsion of the present invention is gelatin, but other hydrophilic colloids such as gelatin derivatives, glaft polymers of gelatin with other polymers, proteins, sugar derivatives, cellulose derivatives, and synthesized hydrophilic high-molecular weight substances such as homo- or copolymers may be used.

The photographic emulsion layers of the photographic material using silver halide emulsions, and other hydrophilic colloidal layers may be hardened with the aid of one or more hardeners that will crosslink the molecule of the binder (or protective colloid) to produce a stronger film. The hardener may be added in an amount sufficient to enable the photographic material to harden to such an extent that there is no need to incorporate any hardener in the processing solution, but if desired, an additional amount of hardener may be present in the processing solution.

Exemplary hardeners include aldehydes (e.g., formaldehyde, glyoxal and glutaraldehyde), N-methylol compounds (e.g., dimethylolurea and methyloldimethylhidantoin), dioxane derivatives (e.g., 2,3-dihydroxydioxane), active vinyl compounds (e.g., 1,3,5-triacryloylhexahydro-s-triazine, 1,3-vinylsulfonyl-2-propanol), active halogen compounds (e.g., 2,4-dichloro-6-hydroxy-s-triazine) and mucohalogenic acids (e.g., mucochloric acid and mucophenoxychloric acid). These hardeners may be employed either singly or in combination with each other.

A plasticizer may be added to the silver halide emulsion layer(s) and/or other hydrophilic colloidal layer(s) in the light-sensitive material of the present invention in order to enhance their flexibility. Compounds which are preferably used as such plasticizers are described in Research Disclosure (RD) No. 17643, XII, A.

A water-insoluble or slightly water-soluble synthetic polymer dispersion (i.e., latex) may also be incorporated in the photographic emulsion layer(s) and other hydrophilic colloidal layer(s) in the light-sensitive material of the present invention in order to improve the dimensional stability of these layers.

Exemplary polymers that can be used in the present invention include those that has as monomer contents alkyl(meth)acrylate, alkoxyalkyl(meth)acrylate, glycidyl(meth)acrylate, (meth)acrylamide, a vinyl ester (e.g., vinyl acetate), acrylonitrile, olefin and styrene, either singly or in combination with each other or with acrylic acid, methacrylic acid, α,β-unsaturated dicarboxylic acid, hydroxyalkyl(meth)acrylate, sulfoalkyl(meth)acrylate and styrenesulfonic acid.

A suitable dye forming coupler usually is selected for each emulsion layer in the photographic material of the present invention.

The dye forming couplers that can be used in the present invention include colored couplers which are capable of achieving color correction, competitive couplers, as well as compounds that couple with the oxidized products of developing agents to release photographically useful fragments such as development restrainers, developing agents, silver halide solvent, toning agents, hardening agents, foggants, antifoggants, chemical sensitizers, spectral sensitizers and desensitizers.

The light-sensitive material of the present invention may be provided with auxiliary layers such as filter layers, anti-halation layers, and anti-irradiation layers. These layers and/or emulsion layers may have incorporated therein dyes that will be dissolved out of the light-sensitive material or bleached during development.

The hydrophilic colloidal layers such as protective layers and intermediate layers in the light-sensitive material of the present invention may contain antifoggants that will serve to prevent the occurrence of fogging due to discharge resulting from the light-sensitive material being electrified by friction or other causes, or UV absorbers for preventing the deterioration of image due to UV radiation.

Silver halide emulsion layers and/or other hydrophilic colloidal layers in the light-sensitive material of the present invention may contain matting agents for the purpose of reducing its gloss, increasing its adaptability to writing with a pencil, or preventing its adhesion to an adjacent light-sensitive material.

The light-sensitive material of the present invention may contain a lubricant that is capable of reducing its sliding friction.

Photographic emulsion layers and/or other hydrophilic colloidal layers in the light-sensitive material of the present invention may contain a variety of surfactants for attaining such purposes as improved coating property, prevention of antistatic buildup, improved slipping property, emulsification/dispersion, antiblocking and improved photographic characteristics in terms of accelerated development, hard tone and sensitization.

The surfactants to be used in the present invention are not particularly limited, but, in addition to the nonionic surfactants containing a polyoxyethylene unit, the following surfactants may be used: natural surfactants such as saponin; nonionic surfactants such as glycerin- and glycidol-based surfactants; cationic surfactants such as higher alkylamines, quaternary ammonium salts, heterocyclic groups (e.g., pyridine), phosphonium and sulfonium compounds; anionic surfactants containing acidic groups such as carboxylic acid, sulfonic acid, phosphoric acid, sulfate esters and phosphate esters; and amphoteric surfactants such as amino acids, aminosulfonic acids, sulfate or phosphate esters of aminoalcohol.

After the support is optionally surface-treated by a suitable technique such as corona discharge, UV irradiation or flame treatment, hydrophilic colloidal layers for making a light-sensitive material may be coated onto the support either directly or with one or more subbing layers formed thereon. The subbing layers are provided for improving the adhesive strength, anti-static property, dimensional stability, wear resistance, hardness, anti-halation property, frictional characteristics and/or other characteristics of the surface of the support.

The concept of the present invention may be applied to a variety of silver halide photographic materials having hydrophilic colloidal layers, such as negative-acting light-sensitive materials, reversal light-sensitive materials, positive-acting light-sensitive materials, direct positive-acting light-sensitive materials, and silver halide photographic materials for use in special applications such as printing, X-ray photography, high-resolution photography, infrared photography, and ultraviolet photography. Desired photographic images can be produced on the silver halide photographic material by processing it appropriately in accordance with the specific application in which it is used.

As will be understood from the foregoing explanation, the silver halide photographic material of the present invention is characterized in that a layer containing an electroconductive material is formed on one surface of the support whereas the outermost layer on the opposite surface of the support where a silver halide emulsion layer is present contains an organopolysiloxane and a nonionic surfactant having a polyoxyethylene unit and/or a fluorine-containing compound. Because of this feature, the photographic material of the present invention displays desired antistatic performance (i.e., no static marks or other troubles due to static buildup will take place) over a much longer period than has been possible in the prior art.

The electroconductive support for use with the silver halide photographic material of the present invention on which a layer containing an electroconductive material is formed is specifically illustrated by the following illustrative cases of its preparation which are set forth here for illustrative purposes only and should by no means taken as limiting.

PREPARATION 1

A copolymer of a maleic acid derivative and vinyl acetate was dissolved in a solvent and the resulting solution was coated on one side of a cellulose triacetate film support to form a subbing layer. To the other side of this support, a coating solution for making an electroconductive layer having the composition indicated below was applied in an amount of 50 $m^2$/1,000 ml:

| | |
|---|---|
| Alumina Sol AS-100 [product of Nissan Chemical Industries, Ltd.; particle size, 50–100 mμ × 10 mμ (needles having a diameter of 10 mμ and a length of 50–100 mμ); containing 0.18 moles of HCl per gram of alumina sol which was an inorganic colloid solution having 10% alumina particles dispersed in water] | 40 g |
| Acetone | 600 ml |
| Methanol | 400 ml |
| Cellulose diacetate | 3 g |

After being dried at 80° C. for 5 minutes, the conductive layer was overlaid with the following hydrophobic-polymer containing coating soltion that was applied in an amount of 55 $m^2$/1,000 ml:

| | |
|---|---|
| Cellulose diacetate | 5 g |
| Acetone | 600 ml |
| Methanol | 400 ml |
| Fine silica particles (average size, 0.2 μm) | 2 g |
| Behenic acid | 2 g |

The applied coating was dried at 80° C. for 5 minutes to make sample A of an electroconductive support.

Preparation 2

As in Preparation 1, the back side of a subbed cellulose triacetate film support was coated with a coating solution for making an electroconductive layer having the composition indicated below, with the deposit ratio being set at 150 $m^2$/1,000 ml:

| | |
|---|---|
| Ionic high-molecular weight compound, IP-13 | 8 g |
| Water | 10 ml |
| Methanol | 650 ml |
| Acetone | 350 ml |

After being dried at 80° C. for 5 minutes, the conductive layer was overlaid with the following hydrophobic-polymer containing coating solution that was applied in an amount of 55 $m^2$/1,000 ml:

| | |
|---|---|
| Cellulose diacetate | 5 g |
| Acetone | 400 ml |
| Methanol | 600 ml |
| Fine silica particles (average size, 0.6 μm) | 1 g |

The applied coating was dried at 80° C. for 5 minutes to make sample B of an electroconductive support.

Preparation 3

Sample C of an electroconductive support was made as in Preparation 2 except that the ionic high-molecular weight compound IP-13 was replaced by IP-6.

Preparation 4

Sample D of an electroconductive support was made as in Preparation 2 except that IP-13 was replaced by IP-28.

Preparation 5

Sample E of an electroconductive support was made as in Preparation 2 except that IP-13 was replaced by IP-27.

Preparation 6

A copolymer of a maleic acid derivative and vinyl acetate was dissolved in a solvent and the resulting solution was coated on one side of a cellulose triacetate film support to form a subbing layer. To the other side of the support, a solution of hydroxypropyl methyl cellulose phthalate in a solvent was applied. The resulting coating was overlaid with a coating solution having the composition indicated below in an amount of 150 $m^2$/1,000 ml, followed by drying to make sample F of an electroconductive support:

| | |
|---|---|
| Ionic high-molecular weight compound, IP-36 | 8 g |

-continued

| | |
|---|---|
| Methyl cellosolve | 50 ml |
| Methanol | 350 ml |
| Acetone | 600 ml |

Preparation 7

Particulate electroconductive metal oxide:

| | |
|---|---|
| Stannic chloride | 130 parts by wt. |
| Antimony chloride | 20 parts by wt. |
| Ethanol | 2,000 parts by wt. |

To a solution having the above-indicated composition, an aqueous solution of 0.5 N sodium hydroxide was added and the pH of the resulting mixture was adjusted to 3 to form a colloidal precipitate.

The precipitate was separated by centrifugation and any excess ions were subsequently removed by washing with water. The excess ion free precipitate was recovered and subjected to heat treatment at 700° C. for 2 hours. The resulting powder was ground into fine particles in a ball mill.

A dispersion of the resulting particles of conductive metal oxide was prepared in accordance with the following formulation:

| | |
|---|---|
| Conductive powder | 5.5 parts by wt. |
| Poly(N-methyl-4-vinylpyridinium chloride) | 1.2 parts by wt. |
| Methanol | 85 parts by wt. |
| Phenol | 15 parts by wt. |

In a separate step, a mixture of vinylidene chloride-/ethyl acrylate/acrylic acid latex was coated on a 100 μm-thick polyethylene terephthalate film to form a subbing layer. To this film, the previously prepared dispersion of conductive metal oxide particles was applied for a dry thickness of 0.15 μm, and dried at 130° C. for 10 minutes. The conductive layer was overlaid with a backing topcoat (for its formulation, see below) in a dry thickness of 0.2 μm so as to make sample G of an electroconductive support:

| | |
|---|---|
| Cellulose acetate | 1 part by wt. |
| Acetone | 70 parts by wt. |
| Cyclohexanone | 25 parts by wt. |
| Phenol | 5 parts by wt. |
| Stearic acid amide | 0.02 parts by wt. |
| Silica particles (average size, 4 μm) | 0.03 parts by wt. |

The following examples are provided for the purpose of further illustrating the present invention but are in no way intended to limit the scope of the invention. Unless otherwise noted, the amounts of components in each of the silver halide photographic materials prepared in the following examples are calculated for square meter. The amounts of silver halide and colloidal silver are expressed in terms of silver.

EXAMPLE 1

A sample of multilayered color photographic element was prepared by coating each one of the conductive supports made in Preparations 1 to 7, with twelve layers having the compositions shown below, wherein the layer arrangement is indicated in order from the support side. The prepared sample is designated sample No. 1 (comparison).

| | |
|---|---|
| First layer: | anti-halation layer (HC-1)<br>Gelatin layer containing black colloidal silver (gelatin content, 2.2 g/m$^2$) |
| Second layer: | intermediate layer (I.L.)<br>Gelatin layer containing an emulsified dispersion of 2,5-di-t-octylhydroquinone (gelatin content, 1.2 g/m$^2$) |
| Third layer: | less red-sensitive silver halide emulsion layer (RL-1) (gelatin content, 1.4 g/m$^2$)<br>Components:<br>monodispersed emulsion (Em-I) with an average grain size (r) of 0.30 μm which was formed of AgBrI with 6 mol % AgI (silver deposit, 1.8 g/m$^2$);<br>sensitizing dye I (6 × 10$^{-5}$ moles per mole of silver);<br>sensitizing dye II (1.0 × 10$^{-5}$ moles per mole of silver);<br>cyan coupler (C-1) (0.06 moles per mole of silver);<br>colored cyan coupler (CC-1) (0.003 moles per mole of silver);<br>DIR compound (D-1) (0.0015 moles per mole of silver);<br>DIR compound (D-2) (0.002 moles per mole of silver); |
| Fourth layer: | highly red-sensitive silver halide emulsion layer (RH-1)<br>Components:<br>monodispersed emulsion (Em-II) with an average grain size (r) of 0.5 μm which was formed of AgBrI with 7.0 mol % AgI (silver deposit, 1.3 g/m$^2$);<br>sensitizing dye I (3 × 10$^{-5}$ moles per mole of silver);<br>sensitizing dye II (1.0 × 10$^{-5}$ moles per mole of silver);<br>cyan coupler (C-1) (0.02 moles per mole of silver);<br>colored cyan coupler (CC-1) (0.0015 moles per mole of silver);<br>DIR compound (D-2) (0.001 mole per mole of silver); |
| Fifth layer: | intermediate layer (I.L.)<br>Same as the second layer |
| Sixth layer: | less green-sensitive silver halide emulsion layer (GL-1)<br>Components:<br>Em-1 (silver deposit, 1.5 g/m$^2$);<br>sensitizing dye III (2.5 × 10$^{-5}$ moles per mole of silver);<br>sensitizing dye IV (1.2 × 10$^{-5}$ moles per mole of silver)<br>magenta coupler (M-1) (0.050 moles per mole of silver);<br>colored magenta coupler (CM-1) (0.009 moles per mole of silver);<br>DIR compound (D-1) (0.0010 mole per mole of silver);<br>DIR compound (D-3) (0.0030 moles per mole of silver); |
| Seventh layer: | highly green-sensitive silver halide emulsion layer (GH-1)<br>Components:<br>Em-II (silver deposit, 1.4 g/m$^2$);<br>sensitizing dye III (1.5 × 10$^{-5}$ moles per mole of silver);<br>sensitizing dye IV (1.0 × 10$^{-5}$ mole per mole of silver);<br>magenta coupler (M-1) (0.020 moles per mole of silver);<br>colored magenta coupler (CM-1) (0.002 moles per mole of silver);<br>DIR compound (D-3) (0.0010 mole per mole of silver); |
| Eighth layer: | yellow filter layer (YC-1) |

-continued

| | |
|---|---|
| | Gelatin layer containing yellow colloidal silver and an emulsified dispersion of 2,5-di-t-dioctyl-hydroquinone |
| Ninth layer: | less blue-sensitive silver halide emulsion layer (BL-1)<br>Components:<br>monodispersed emulsion (Em-III) with an average grain size of 0.48 μm which was formed of AgBrI with 6 mol % AgI (silver deposit, 0.9 g/m$^2$)<br>sensitizing dye V (1.3 × 10$^{-5}$ moles per mole of silver)<br>yellow coupler (Y-1) (0.29 moles per mole of silver); |
| Tenth layer: | highly blue-sensitive silver halide emulsion layer (BH-1)<br>Components:<br>monodispersed emulsion (Em-IV) with an average grain size of 0.8 μm which was formed of AgBrI with 15 mol % AgI (silver deposit, 0.5 g/m$^2$)<br>sensitizing dye V (1.0 × 10$^{-5}$ mole per mole of silver);<br>yellow coupler (Y-1) (0.08 moles per mole of silver);<br>DIR compound (D-2) (0.0015 moles per mole of silver); |
| Eleventh layer: | first protective layer (Pro-1)<br>Gelatin layer containing AgBrI (1 mol % AgI; average grain size, 0.07 μm; silver deposit, 0.5 g/m$^2$), UV absorbers, UV-1 and UV-2, and formaldehyde scavenger HS-1 |
| Twelfth layer: | second protective layer (Pro-2) |

| Preparation of a dispersion of organopolysiloxane: | | |
|---|---|---|
| Solution A | organopolysiloxane (for its name, see Table 1) | 2.0 g |
| | ethyl acetate | 1.5 g |
| Solution B | gelatin (5% aq. sol.) | 20 ml |
| | sodium triisopropylnaphthalene-sulfonate | 2.0 g |
| Solution | gelatin (7% aq. sol.) | 50 ml |

A mixture of solutions A and B was charged into an MG homogenizer (valve type Manton-Gaulin homogenizer) which was so controlled as to provide a dispersion of particles having an average size of 0.8 μm. To the dispersion, solution C was added. Subsequently, water was added to make 80 ml and thereby prepare a dispersion of organopolysiloxane.

| Coating solution for making Pro-2: | |
|---|---|
| Dispersion of organopolysiloxane | 70 ml |
| Nonionic surfactant, N-23 | 2 g |
| Gelatin | 40 g |
| Fluorine-containing compound (see Table 1) | 0.5 g |
| Sodium amyldecylsulfosuccinate | 1.0 g |
| Particles of a copolymer of ethyl methacrylate (30 mol %)/methyl methacrylate (30 mol %)/methacrylic acid (40 mol %) (average size, 2.2 μm) | 4.0 g |
| 1,2-Bisvinylsulfonylethane | 2.0 g |
| Water | to make 1,000 ml |

Average grain size measurement was conducted with Horiba Automatic Particle Size Distribution Analyzer. CA-PA-500 (Horiba, Ltd.). The coating solution specified above was applied to make Pro-2 for a gelatin content of 20.6 g/m$^2$.

Besides the compositions shown above, a high-boiling point organic solvent, gelatin hardeners (H-1) and (H-2), and a surfactant were added to each of the constituent layers. The type of each support used in Example 1, as well as the organopolysiloxane, the nonionic surfactant having a polyoxyethylene unit, and the fluorine-containing compound that were incorporated in the 12th layer are identified in Table 1.

The compounds incorporated in layers 1 to 11 are shown more specifically below.

| | |
|---|---|
| Sensitizing dye I: | anhydro-5,5'-dichloro-9-ethyl-3,3'-di-(3-sulfopropyl)thiacarbocyanine hydroxide |
| Sensitizing dye II: | anhydro-9-ethyl-3,3'-di-(3-sulfopropyl)-4,5,4',5'-dibenzothiacarbocyanine hydroxide |
| Sensitizing dye III: | anhydro-5,5'-diphenyl-9-ethyl-3,3'-di-(3-sulfopropyl)oxacarbocyanine hydroxide |
| Sensitizing dye IV: | anhydro-9-ethyl-3,3'-di-(3-sulfopropyl)-5,6,5',6'-dibenzoxacarbocyanine hydroxide |
| Sensitizing dye V: | anhydro-3,3'-di-(3-sulfopropyl)-4,5-benzo-5'-methoxythiacyanine hydroxide |

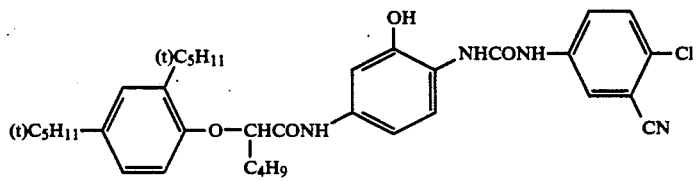

C-1

-continued
CC-1
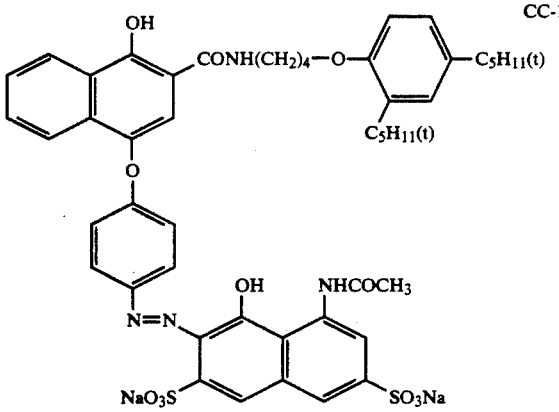
D-1
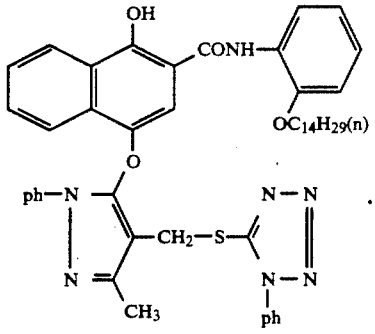
D-2
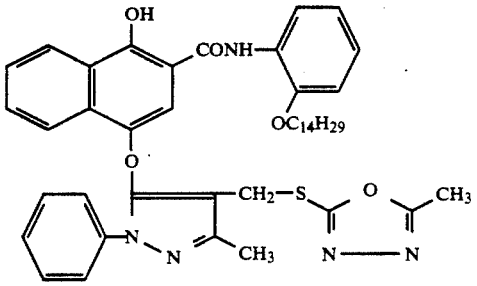
D-3
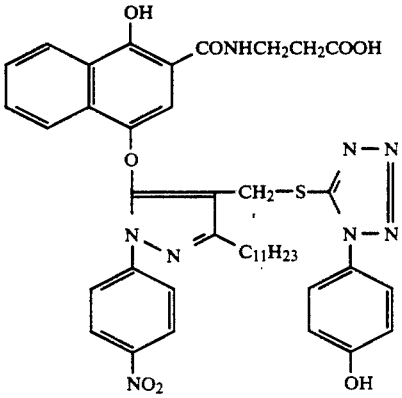
M-1
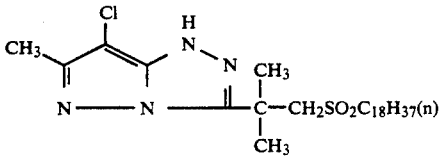
CM-1
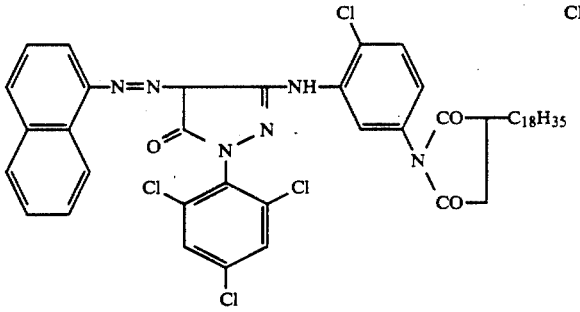
Y-1
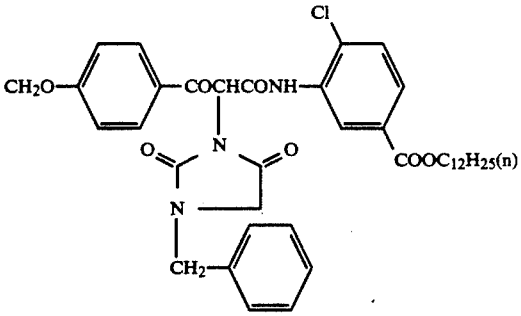
UV-1
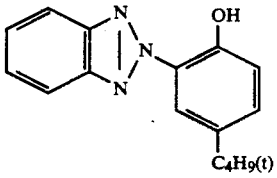
UV-2
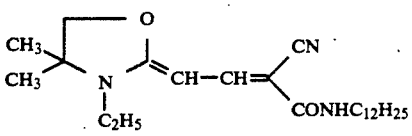
HS-1
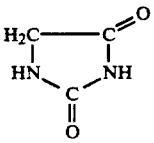

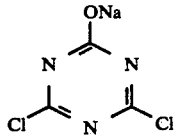

H-1

-continued $$[C(CH_2SO_2CH{=}CH_2)_4]_m[H_2N{-}CH_2CH_2SO_3K]_n$$
m:n = 2:1

H-2

Sample Nos. 1 to 23 of the present invention and comparative sample Nos. 24 to 28 were prepared as indicated in Table 1. The performance of each sample was evaluated by the following procedures.

Time-dependent deterioration of electroconductivity under exposure to high humidity Test pieces measuring 10 cm long and 3.5 cm wide were made from each sample. After being conditioned in a humid atmosphere (80% r.h.×25° C.) for 24 hours, the test pieces were placed one on top of another in such a manner that the antistatic surface of one test piece was in contact with the emulsion-coated surface of an adjacent piece. With a load of 500 g being applied, the stack of test pieces was left in a hot and humid atmosphere (80% r.h.×45° C.) for 6 hours and the individual pieces were peeled away from one another. Thereafter, the separated individual pieces were placed at 25° C. and 55% r.h. for 24 hours. The specific sheet resistivity of the back side of each sample was measured and recorded as $R_{s1}$. In a separate test, the test pieces were immediately placed at 25° C. and 55% r.h. for 24 hours without being exposed in a stacked form to a hot and humid atmosphere. The specific sheet resistivity of the back side of each sample in this case was measured and recorded as $R_{s0}$. The time-dependent deterioration of electroconductivity was evaluated in terms of the increase in specific sheet resistivity, which was defined as $\log R_{s1}/R_{s0}$. The greater the value of this factor, the more deteriorated the antistatic performance of a specific sample was.

Generation of static marks

An unexposed sample was conditioned at 25° C. and 25% r.h. for 12 hours. The sample was transferred to a dark place having the same atmospheric condition (25° C.×25% r.h.) and the emulsion-coated surface and the back surface of the sample were rubbed by passage between neoprene rubber rollers. Thereafter, the sample was developed, bleached, fixed, washed and stabilized as indicated below. The severity of the occurrence of static marks on the processed sample was examined.

Test pieces were prepared from each sample and placed in a stacked form in a dark area under the same atmospheric conditions as used in the test of time-dependent deterioration of electroconductivity under exposure to high humidity. Thereafter, the individual test pieces were peeled apart and conditioned at 25° C. and 25% r.h. for 12 hours. Each sample was then developed, bleached, fixed, washed and stabilized as indicated below, and the severity of the occurrence of static marks on the processed sample was also examined.

The following criteria were used in evaluating the severity of static mark generation:

A: no static mark;
B: a few static marks;
C: extensive static marks;
D: static marks developed in almost the entire surface of the sample.

| Processing steps (38° C.) | Time |
|---|---|
| Color development | 3 min and 15 sec |
| Bleaching | 6 min and 30 sec |
| Washing | 3 min and 15 sec |
| Fixing | 6 min and 30 sec |
| Washing | 3 min and 15 sec |
| Stabilizing | 1 min and 30 sec |

The following processing fluids were used.

| | |
|---|---|
| **Color developing solution** | |
| 4-Amino-3-methyl-N-ethyl-N-(β-hydroxyethyl)-aniline sulfate | 4.75 g |
| Anhydrous sodium sulfite | 4.25 g |
| Hydroxylamine hemisulfate | 2.0 g |
| Anhydrous potassium carbonate | 37.5 g |
| Sodium bromide | 1.3 g |
| Nitrilotriacetic acid trisodium salt (monohydrate) | 2.5 g |
| Potassium hydroxide | 1.0 g |
| Water | to make 1,000 ml |
| Ph adjusted to 10.0 with potassium hydroxide | |
| **Bleaching solution** | |
| Ethylenediaminetetraacetic acid iron (II) ammonium salt | 100.0 g |
| Ethylenediaminetetraacetic acid diammonium salt | 10.0 g |
| Ammonium bromide | 150.0 g |
| Glacial acetic acid | 10.0 ml |
| Water | to make 1,000 ml |
| pH adjusted to 6.0 with aqueous ammonia | |
| **Fixing solution** | |
| Ammonium thiosulfate (50% aq. sol.) | 162 ml |
| Anhydrous sodium sulfite | 12.4 g |
| Water | to make 1,000 ml |
| pH adjusted to 6.5 with acetic acid | |
| **Stabilizing solution** | |
| Formaldehyde (37% aq. sol.) | 5.0 ml |
| Konidax (Konishiroku Photo Industry Co., Ltd.) | 7.5 ml |
| Water | to make 1,000 ml |

TABLE 1

| | Sample No. | Support | Organopolysiloxane | Nonionic surfactant | Fluorine-containing surfactant | Time-dependent deterioration of electroconductivity | Generation of static marks: not exposed to high humidity | Generation of static marks: exposed to high humidity |
|---|---|---|---|---|---|---|---|---|
| Samples of the invention | 1 | A | S-1 | N-23 | F-8 | 0.10 | A | A |
| | 2 | A | S-7 | N-29 | F-55 | 0.15 | A | A |
| | 3 | A | S-8 | N-46 | F-44 | 0.10 | A | A |
| | 4 | A | S-27 | N-29 | F-33 | 0.50 | A | A |
| | 5 | A | S-29 | N-23 | F-45 | 0.10 | A | A |
| | 6 | A | S-13 | N-46 | F-5 | 0.10 | A | A |
| | 7 | A | S-7 | — | F-8 | 0.29 | A | B |
| | 8 | A | S-8 | N-23 | — | 0.40 | A | A |

TABLE 1-continued

| | Sample No. | Support | Organopoly-siloxane | Nonionic surfactant | Fluorine-containing surfactant | Time-dependent deterioration of electro-conductivity | Generation of static marks: not exposed to high humidity | Generation of static marks: exposed to high humidity |
|---|---|---|---|---|---|---|---|---|
| | 9 | A | S-7 | — | F-16 | 0.35 | A | B |
| | 10 | B | S-7 | N-29 | F-5 | 0.10 | A | A |
| | 11 | B | S-8 | N-46 | F-55 | 0.10 | A | A |
| | 12 | B | S-29 | N-23 | F-8 | 0.15 | A | A |
| | 13 | B | S-7 | — | F-8 | 0.20 | A | B |
| | 14 | B | S-8 | N-46 | — | 0.45 | A | A |
| | 15 | B | S-8 | N-46 | F-18 | 0.20 | A | A |
| | 16 | B | S-1 | N-23 | F-19 | 0.25 | A | A |
| | 17 | B | S-7 | — | F-32 | 0.30 | A | B |
| | 18 | C | S-29 | N-29 | F-55 | 0.15 | A | A |
| | 19 | C | S-1 | N-46 | F-8 | 0.10 | A | A |
| | 20 | D | S-7 | N-23 | F-19 | 0.15 | A | A |
| | 21 | D | S-8 | N-29 | F-3 | 0.10 | A | A |
| | 22 | E | S-27 | N-29 | F-15 | 0.10 | A | A |
| | 23 | E | S-29 | N-46 | F-21 | 0.15 | A | A |
| Comparative samples | 24 | A | — | N-23 | — | 2.00 | A | D |
| | 25 | B | — | N-46 | F-8 | 1.50 | A | D |
| | 26 | C | — | — | F-55 | 2.70 | B | D |
| | 27 | D | S-7 | — | — | 3.00 | C | D |
| | 28 | B | — | — | — | 3.00 | C | D |

As one can see from Table 1, sample Nos. 1 to 23 prepared in accordance with the present invention experienced small variations in electroconductivity with time and, hence, suffered from small degrees of deterioration in their antistatic properties.

Among these samples of the present invention, sample Nos. 1 to 6, 10 to 12, 15, 16 and 18 to 23 in which the organopolysiloxane, nonionic surfactant and fluorine-containing compound specified by the present invention were incorporated in the outermost layer experienced a very small variation in electroconductivity with time and were rated "A" in their ability to suppress the generation of static marks.

Sample Nos. 8 and 14 contained the organopolysiloxane and nonionic surfactant in the outermost layer but not the fluorine-containing compound. These samples suffered a certain, but permissible, amount of variation in electroconductivity with time. Even when they were stored in a stacked form in a humid atmosphere, their ability to suppress the generation of static marks was rated "A", indicating their being well suited for use in practical applications.

Sample Nos. 7, 9, 13 and 17 contained the organopolysiloxane and fluorine-containing compound in the outermost layer but not the nonionic surfactant. These samples also suffered a certain, but well permissible, amount of variation in electroconductivity with time. Even when they were stored in a stacked form in a humid atmosphere, their ability to suppress the generation of static marks was rated "B", indicating their being still satisfactory for use in practical applications.

Comparative sample Nos. 24 to 26 and 28 contained no organopolysiloxane in the outermost layer unlike in the samples of the present invention. Comparative sample No. 27 contained the organopolysiloxane in the outermost layer but neither the nonionic surfactant nor the fluorine-containing compound was present in that layer. These samples suffered very large variations in electroconductivity with time. When they were stored in a stacked form in a humid condition, their ability to suppress the generation of static marks was rated "D", indicating their being unsuitable for use in practical applications.

In short, the outermost layer containing either the nonionic surfactant or the fluorine-containing compound alone without containing the organopolysiloxane suffered a very large variation in electroconductivity with time. The protective layer containing both the nonionic surfactant and fluorine-containing compound but not containing the organopolysiloxane also suffered a great variation in electroconductivity with time. In either case, static marks occurred in almost the entire surface of the photographic material (rating "D") and rendered it unsuitable for use in practical applications.

EXAMPLE 2

A silver halide emulsion containing high-sensitivity silver halide grains (98.5 mol % AgBr and 1.5 mol % AgI; average grain size, 1.0 μm) was chemically sensitized. To the sensitized emulsion, the following photographic addenda were added:

| Additive | Amount (per mole of silver) |
|---|---|
| 4-Hydroxy-6-methyl-1,3,3a,7-tetrazaindene | 1.2 g |
| Diethylene glycol | 11.0 g |
| Glyoxal | 1.2 g |
| Sodium diethylhexyl sulfosuccinate | 1.5 g |
| Paranitrophenyl-triphenyl phosphide chloride | 0.2 g |

The coating solution thus prepared was applied to a selected support (for its type, see Table 2) to give silver and gelatin deposits of 4 g/m$^2$ and 1.7 g/m$^2$, respectively. The resulting emulsion coating was overlaid with a protective layer that was formed from the formulation indicated below and which was coated to give a gelatin deposit of 1.2 g/m$^2$. By these procedures, sample Nos. 29–36 of the present invention and comparative sample Nos. 37–39 were prepared as noted in Table 2.

| Formulation of protective layer: | |
|---|---|
| gelatin | 100 g |
| sodium diethylhexyl sulfosuccinate | 1 g |
| mucochloric acid | 1 g |
| polymethyl methacrylate particles | 4 g |

-continued

| Formulation of protective layer: | |
|---|---|
| (average size, 3-4 μm) | |
| nonionic surfactant | 2 g |
| dispersion of organopolysiloxane | 150 ml |
| fluorine-containing compound | 1.0 g |

The specific types of support, nonionic surfactant with a polyoxyethylene unit, and organopolysiloxane used are identified in Table 2.

The prepared samples were subjected to evaluations of change with time in electroconductivity and the severity of static mark generation by employing the same methods as used in Example 1.

These samples were processed photographically in accordance with the following schedule:

| Steps | Temperature | Time |
|---|---|---|
| development | 30° C. | 45 sec |
| fixing | 25° C. | 35 sec |
| washing | 15° C. | 35 sec |
| drying | 45° C. | 20 sec |
| Developer | | |
| Phenidone | | 0.4 g |
| Methol | | 5 g |
| hydroquinone | | 1 g |
| sodium anhydrous sulfite | | 60 g |
| sodium carbonate (monohydrate) | | 54 g |
| 5-nitroimidazole | | 0.1 g |
| potassium bromide | | 2.5 g |
| water | | to make 1,000 ml |
| pH adjusted to 10.20 | | |

ductivity with time and was affected by extensive generation of static marks.

Therefore, if, in accordance with the present invention, an organopolysiloxane and a nonionic surfactant having a polyoxyethylene unit and/or a fluorine-containing compound are incorporated in the outermost layer of a silver halide photographic material on the side of a support where an emulsion layer is formed, the photographic material is provided with excellent antistatic performance that experiences a minimum degree of deterioration with time as manifested by negligible formation of static marks.

EXAMPLE 3

Sample Nos. 1, 7, 8, 11, 13, 14, 24, 25 and 26 prepared in Example 1 were each cut in a dark place into several pieces with dimensions of 3.5 $cm^W$ by 120 $cm^L$. Such test pieces were accommodated in cartridges and left for 3 days at 25° C. under varying humidity conditions (45%, 53%, 57% and 62% r.h.). Thereafter, the individual cartridges were placed in polypropylene cases and closed hermetically at the above-specified humidities. The test pieces in cartridge cases were left for 7 days at 60° C.

The test pieces were taken out of their cartridge cases and each of them was cut to shorter lengths of 10 cm. The resulting small segments were subjected to evaluation of time-dependent deterioration in the electroconductivity of backing topcoat in accordance with the same method as employed in Example 1 for making evaluation of time-dependent deterioration in conductivity at high humidity.

The same test pieces that had been exposed to varying humidities for 3 days before being left for 7 days at 60° C. were subjected to evaluation of the severity of static mark generation by the same method as used in Example 1.

The same test pieces were also checked for their sensitivity to scum formation by the following method: each test piece was continuously processed according to the scheme shown in Example 1 and the formation of scum on the processed film surface was visually evaluated by the following criteria:

A: no scum formation

B: slight scum formation

C: noticeable scum formation

D: extensive scum formation.

The results of three evaluations are summarized in Table 3.

TABLE 2

| | Sample No. | Support | Organopolysiloxane | Nonionic surfactant | Fluorine-containing compound | Time-dependent deterioration of electroconductivity | Generation of static marks: not exposed to high humidity | Generation of static marks: exposed to high humidity |
|---|---|---|---|---|---|---|---|---|
| samples of the invention | 29 | A | S-27 | N-29 | F-8 | 0.05 | A | A |
| | 30 | B | S-7 | N-46 | F-55 | 0.15 | A | A |
| | 31 | F | S-29 | N-23 | F-5 | 0.05 | A | A |
| | 32 | F | S-8 | N-29 | F-44 | 0.05 | A | A |
| | 33 | G | S-13 | N-23 | F-55 | 0.00 | A | A |
| | 34 | G | S-7 | N-46 | F-8 | 0.00 | A | A |
| | 35 | F | S-13 | N-29 | — | 0.10 | A | A |
| | 36 | G | S-8 | — | F-8 | 0.25 | A | B |
| comparative samples | 37 | B | — | N-46 | — | 1.25 | A | C |
| | 38 | G | — | N-23 | F-55 | 1.00 | A | C |
| | 39 | F | — | — | F-8 | 2.00 | A | D |

As one can see from Table 2, sample Nos. 29 to 36 prepared in accordance with the present invention experienced very small variations in electroconductivity with time and were practically insusceptible to generation of static marks. In contrast, comparative sample Nos. 37 to 39 experienced very great variations in electroconductivity with time and were highly susceptible to generation of static marks when stored in a stacked form in a humid atmosphere. In other words, the protective layer containing either nonionic surfactant or the fluorine-containing compound alone without containing the organopolysiloxane suffered a deterioration in antistatic performance and was affected by extensive generation of static marks. Even the protective layer containing both the nonionic surfactant and fluorine-containing compound but not containing the organopolysiloxane also suffered a great change in electrocon-

TABLE 3

| | Humidity (r.h.) for storage at 25° C. | Sample No. | Time-dependent deterioration of electroconductivity | Generation of static marks: not exposed to high humidity | Generation of static marks: exposed to high humidity | Scum formation |
|---|---|---|---|---|---|---|
| samples of the invention | 45% | 1 | 0.05 | A | A | A |
| | | 7 | 0.15 | A | A | A |
| | | 8 | 0.20 | A | A | A |
| | | 11 | 0.05 | A | A | A |
| | | 13 | 0.05 | A | A | A |
| | | 14 | 0.15 | A | A | A |
| comparative samples | 45% | 24 | 0.70 | A | D | A |
| | | 25 | 2.60 | A | D | A |
| | | 26 | 1.90 | B | D | A |
| samples of the invention | 53% | 1 | 0.05 | A | A | A |
| | | 7 | 0.20 | A | A | A |
| | | 8 | 0.30 | A | A | A |
| | | 11 | 0.05 | A | A | A |
| | | 13 | 0.10 | A | A | A |
| | | 14 | 0.20 | A | A | A |
| comparative samples | 53% | 24 | 1.20 | A | D | A |
| | | 25 | 2.70 | A | D | A |
| | | 26 | 2.00 | B | D | A |
| samples of the invention | 57% | 1 | 0.10 | A | A | B |
| | | 7 | 0.25 | A | B | A |
| | | 8 | 0.35 | A | A | B |
| | | 11 | 0.10 | A | A | B |
| | | 13 | 0.20 | A | B | A |
| | | 14 | 0.40 | A | A | B |
| comparative samples | 57% | 24 | 1.50 | A | D | A |
| | | 25 | 2.70 | A | D | A |
| | | 26 | 2.00 | B | D | A |
| samples of the invention | 62% | 1 | 0.10 | A | A | B |
| | | 7 | 0.30 | A | B | A |
| | | 8 | 0.40 | A | A | B |
| | | 11 | 0.10 | A | A | B |
| | | 13 | 0.20 | A | B | A |
| | | 14 | 0.45 | A | A | B |
| comparative samples | 62% | 24 | 1.50 | A | D | A |
| | | 25 | 2.70 | A | D | A |
| | | 26 | 2.00 | B | D | A |

As Table 3 shows, the samples of the present invention used in Example 3 suffered a very small deterioration in the electroconductivity of the backing topcoat. Even when they were stored in a stacked form at high humidity, they proved to be highly insensitive to static mark generation and the severity of scum formation that occurred as a result of photographic processing was at a permissible level. Time-dependent deterioration in the electroconductivity of backing topcoat could be further reduced by keeping the photographic material at relative humidities of 55% or below in the beginning of storage period. By so doing, the generation of static marks was completely suppressed in sample Nos. 7 and 13 which contained organopolysiloxane and a fluorine-containing compound in the topcoat but which did not contain a nonionic surfactant in that layer. A small amount of scum formed in sample Nos. 8 and 14 which contained organopolysiloxane and a nonionic surfactant in the topcoat but which did not contain a fluorine-containing compound in that layer; however, this problem could be eliminated by storing the samples at relative humidities of 55% or below.

What is claimed is:

1. A silver halide photographic element comprising:

(a) a support containing a material selected from the group consisting of a polyolefin, a polystyrene, a cellulose derivative and a cellulose ester, (b) a conductive layer comprising 0.005-2.0 g/m$^2$ of an ion-conductive material on one surface of said support.

wherein said ion-conductive material includes 1) an electrolyte containing metal oxide sol in which electrical conductivity is imparted by anions, or 2) an ionic high-molecular weight compound having the structural formula (I) or (II-A and II-B) as follows:

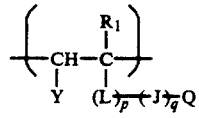

(I)

wherein $R_1$ is a hydrogen atom, an alkyl group having 1-4 carbon atoms, a halogen atom, or $-CH_2COO^{\ominus}M^{\oplus}$; Y is $-COO^{\ominus}M^{\oplus}$ or a hydrogen atom; L is —CONH—, —COO—, —CO or —O—; J is a divalent group having a substituted or unsubstituted $C_{1-12}$ alkylene, arylene, alkylenearyl or arylenealkylene group; Q is a group having a cationic or anionic disassociative group, selected from $-O^{\oplus}M^{\ominus}$, $-SO_3^{\oplus}M^{\ominus}$,

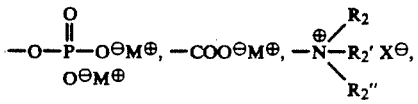

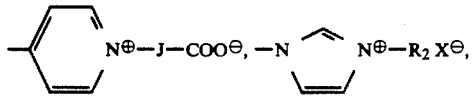

-continued

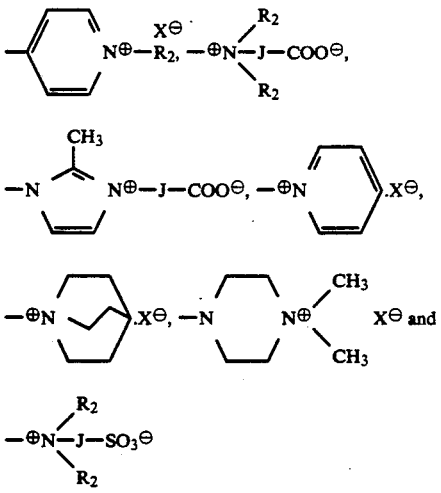

or a group having a cationic disassociative group with a quarternary nitrogen atom; M is a hydrogen atom or a cation; $R_2$, $R_2'$ and $R_2''$ are each a substituted or unsubstituted $C_{1-4}$ alkyl group; p and q are each an integer of 0 or 1; and X is an anion;

(II-A)

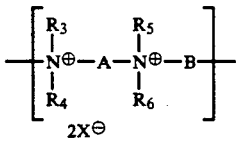

(II-B)

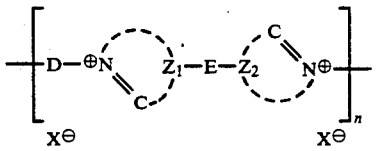

wherein $R_3$, $R_4$, $R_5$ and $R_6$ are each a substituted or unsubstituted $C_{1-4}$ alkyl group, provided that $R_3$ and $R_5$ and/or $R_4$ and $R_6$ may combine together to form a nitrogenous heterocyclic ring; A, B and D are each a substituted or unsubstituted $C_{2-10}$ alkylene provided that the alkylene may be interrupted by an arylene group, arylene, alkenylene, arylenealkylene, alkylenearylene, $—R_7COR_8—$, $—R_9COOR_{10}—OCOR_{11}—$, $R_{12}OCOR_{13}—COOR_{14}—$, $—R_{15}—(OR_{16}—)_m$, $—R_{17}CONHR_{18}NHCOR_{19}$, $—R_{20}CONHR_{21}NHCOR_{22}$ or $—R_{23}NHCONHR_{24}—NHCONHR_{25}$, where $R_7$, $R_8$, $R_9$, $R_{11}$, $R_{12}$, $R_{14}$, $R_{15}$, $R_{16}$, $R_{17}$, $R_{19}$, $R_{20}$, $R_{22}$, $R_{23}$, and $R_{25}$ are each an alkylene group, and $R_{10}$, $R_{13}$, $R_{18}$, $R_{21}$ and $R_{24}$ are each a linkage selected from a substituted or unsubstituted alkylene, alkenylene, arylene, arylenealkylene, and alkylenearylene group; m is an integer of 1-4; $X^{\ominus}$ is an anion, provided that when A is an alkylene hydroxyalkylene or arylenealkylene group B is not an alkylene, hydroxyalkylene or arylenealkylene; E is a simple linkage, $—NHCOR_{26}CONH—$ or a group recited above for D; $R_{26}$ being a substituted or unsubstituted alkylene, alkylene, arylene, arylenealkylene or alkylenearylene group; $Z_1$ and $Z_2$ each represents a nonmetallic atomic group necessary to form a 5- or 6-membered ring together with a —N=C— group; and n is an integer of 5-300, (c) at least one silver halide emulsion layer on the other surface of the support, and (d) an outer layer on the side of the support carrying the silver halide emulsion layer which contains, in an amount effective to diminish static marks, an organopolysiloxane, a nonionic surfactant having a polyoxyethylene unit, and 0.5-500 mg/m$^2$ of a fluorine-containing compound selected from the group consisting of a fluorine-containing surfactant and a fluorine-containing polymer, wherein the ratio of said organopolysiloxane: said nonionic surfactant: said fluorine-containing compound is 1:(0.1-5):(0.5-20), wherein said organopolysiloxane is represented by the formula (III) as follows:

(III)

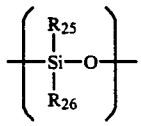

wherein $R_{25}$ is a hydrogen atom, a hydroxyl group or an organic group; $R_{26}$ is an organic group, provided that $R_{25}$ and $R_{26}$ may be the same or different, wherein said organopolysiloxane is terminated by end groups represented by the formula (IV) as follows:

(IV)

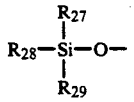

wherein $R_{27}$, $R_{28}$ and $R_{29}$ are each a hydrogen atom, a halogen atom, a hydroxy group or an organic group, provided that $R_{27}$, $R_{28}$ and $R_{29}$ may be the same or different, wherein said nonionic surfactant is represented by the formulas (N-I), (N-II) and (N-III) as follows:

$$R'—A(CH_2CH_2O)_{n1}H \quad \text{(N-I)}$$

(N-II)

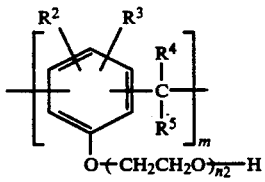

(N-III)

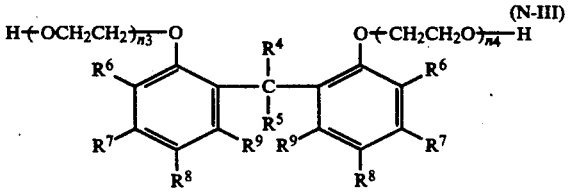

wherein $R^1$ is a hydrogen atom or substituted alkyl, alkenyl or aryl group having 1-30 carbon atoms; A is —O—, —S—, $-\underset{\underset{R^{17}}{|}}{CON}-$, $-COO-$, $-OCO-$, $-\underset{|}{N}-R^{10}-CO-\underset{|}{N}-R^{10}$ or $-SO_2\underset{|}{N}R^{10}$, wherein $R^{10}$ is a hydrogen atom or a substituted alkyl group, $R^{17}$ is a hydrogen atom, an alkyl group or $-(CH_2CH_2O)n_5-H$, $R^2$, $R^3$, $R^7$ and $R^9$ are each a hydrogen atom, a halogen atom, or a substituted or unsubstituted alkyl group, aryl group, alkoxy group, aryloxy group, acyl group, amido group, sulfonamido group, carbamoyl group or sulfamoyl group; $R^6$ and $R^8$ are each a halogen atom or a substituted or unsubstituted alkyl group, aryl group, alkoxy group, aryloxy group, acyl group, amido group, sulfonamido group, carbamoyl group or sulfamoyl group;

$R^4$ and $R^5$ are each a hydrogen atom, substituted or unsubstituted alkyl group, aryl group or furyl group, $R^4$ and $R^5$, $R^6$ and $R^7$, and $R^8$ and $R^9$ may combine together to for a ring, provided that the phenyl rings in formula (N-III) are symmetric with respect to the vertical center line thereof; $n_1$, $n_2$, $n_3$, $n_4$ and $n_5$ each denotes the average number of moles of ethylene oxide added which is in the range of about 3–50; and m is an integer of 2–50, wherein said fluorine-containing surfactant is represented by the formula (F) as follows:

$$Rf-(A)_m-X \qquad (F)$$

wherein Rf is a substituted or unsubstituted alkyl group having at least 3 fluorine atoms, a substituted or unsubstituted alkyloxy group having at least 3 fluorine atoms, a substituted or unsubstituted alkenyl group having at least 3 fluorine atoms or a substituted or unsubstituted aryl group having at least 3 fluorine atoms; A is a divalent linking group; X is a hydrophilic group; and m is 0 or 1, and said fluorine-containing polymers are represented by the formulas (F-I), (F-II) and (F-III) as follows:

$$CH_2=\underset{\underset{COO(X)_pRf_3}{|}}{\overset{\overset{R_1}{|}}{C}} \qquad (F\text{-}I)$$

-continued $$CH_2=\underset{\underset{O-Rf_2}{|}}{\overset{\overset{R_2}{|}}{C}} \qquad (F\text{-}II)$$

$$(R_4)_q-C_6H_4-[(X)_pRf_3]S \qquad (F\text{-}III)$$

wherein $R_1$ and $R_2$ each denotes a hydrogen atom or a methyl group that may be substituted by a fluorine atom; $Rf_2$ is a straight-chained, branched or cyclic alkyl group that is substituted by a fluorine atom, provided that the carbon chain of the alkyl group represented by $Rf_2$ may be interrupted by a linking group selected from oxo, thio and carbonyl; $R_3$ is a hydrogen atom, a chlorine atom or an alkyl group having 1–3 carbon atoms; $R_4$ is a univalent substituent and if g is 2 or greater, two or more of $R_4$ may combine with each other to form a ring; $Rf_3$ is an alkyl, arylalkyl, aryl or alkylaryl group with 1–30 carbon atoms in which at least one hydrogen atom is replaced by a fluorine atom; X is a divalent linking group of the formula $R-_tL$ or $-L(-R-)_t$ wherein R is a $C_{1-10}$ alkylene, arylene or aralkylene group; —L— is —O—, —S—, —HN—, —CO—, —OCO—, —CO—O—S-CO—, —CONH—, —NHCO—, $-SO_2$, $-NR_5SO_2-$, $-SO_2NH-$, —SO—, or $-OPO_2-$, wherein $R_5$ is a hydrogen atom or an alkyl group having 1–4 carbon atoms; t is 0 or 1; q is an integer of 1–4;

and s is an integer of 1–5.

2. A silver halide photographic element according to claim 1, wherein the fluorine-containing compound is a fluorine-containing surfactant, and the hydrophilic group of said fluorine-containing surfactant is a non-ionic, hydrophilic betaine or hydrophilic anionic group.

3. A silver halide photographic element according to claim 2, wherein the fluorine-containing compound is a fluorine-containing surfactant, and said fluorine-containing surfactant is a hydrophilic anionic group.

4. A silver halide photographic element according to claim 1, wherein said ion-conductive material employing anions as charge carriers is an ionic high-molecular weight compound containing a quaternary nitrogen atom.

* * * * *

UNITED STATES PATENT AND TRADEMARK OFFICE

CERTIFICATE OF CORRECTION

PATENT NO. : 5,137,802

DATED : August 11, 1992

INVENTOR(S) : Eiichi Ueda et al.

It is certified that error appears in the above-identified patent and that said Letters Patent is hereby corrected as shown below:

Claim 1, Column 64, Line 57 "$-O^{+}M^{-}$, $-SO_3{}^{+}M^{-}$" should read -- $-O^{-}M^{+}$, $-SO_3{}^{-}M^{+}$--;

Claim 1, Column 65, Line 66 "alkylene" (second occurrence) should read--alkenylene--.

Claim 1, Column 67, Line 27 "for" should read --form--.

Claim 1, Column 68, Line 37 after "of", "1-4" should read --0-4--.

UNITED STATES PATENT AND TRADEMARK OFFICE

CERTIFICATE OF CORRECTION

PATENT NO. : 5,137,802

DATED : August 11, 1992

INVENTOR(S) : Eiichi Ueda et al

It is certified that error appears in the above-indentified patent and that said Letters Patent is hereby corrected as shown below:

Claim 1, Column 65, LIne 23 "quarternary" should read --quaternary--.

Signed and Sealed this

Fourth Day of January, 1994

Bruce Lehman

*Attest:*

BRUCE LEHMAN

*Attesting Officer*

*Commissioner of Patents and Trademarks*